US008225533B2

(12) United States Patent
Meschan

(10) Patent No.: US 8,225,533 B2
(45) **Date of Patent: *Jul. 24, 2012**

(54) COMPONENT FOR USE IN A SHOE

(75) Inventor: David F. Meschan, Greensboro, NC (US)

(73) Assignee: Akeva, L.L.C., Greensboro, NC (US)

( * ) Notice: Subject to any disclaimer, the term of this patent is extended or adjusted under 35 U.S.C. 154(b) by 403 days.

This patent is subject to a terminal disclaimer.

(21) Appl. No.: 12/454,603

(22) Filed: May 20, 2009

(65) Prior Publication Data

US 2009/0229143 A1 Sep. 17, 2009

Related U.S. Application Data

(63) Continuation-in-part of application No. 12/070,143, filed on Feb. 15, 2008, now Pat. No. 7,624,516, which is a continuation of application No. 10/924,228, filed on Aug. 23, 2004, now Pat. No. 7,331,124.

(60) Provisional application No. 60/497,228, filed on Aug. 22, 2003.

(51) Int. Cl.
*A43B 13/00* (2006.01)

(52) U.S. Cl. ..... 36/35 R; 36/27; 36/37; 36/28

(58) Field of Classification Search ..... 36/27–29, 36/35 R, 37, 35 B, 114
See application file for complete search history.

(56) References Cited

U.S. PATENT DOCUMENTS

| | | | | |
|---|---|---|---|---|
| 2,174,752 | A * | 10/1939 | Laursen | 36/35 R |
| 5,224,277 | A | 7/1993 | Sang Do | |
| 5,595,004 | A | 1/1997 | Lyden et al. | |
| 5,598,645 | A | 2/1997 | Kaiser | |
| 5,813,141 | A | 9/1998 | Cho | |
| 5,842,291 | A | 12/1998 | Schmidt et al. | |
| 5,901,467 | A | 5/1999 | Peterson et al. | |
| 5,918,384 | A | 7/1999 | Meschan | |
| 5,987,780 | A | 11/1999 | Lyden et al. | |
| 6,026,593 | A | 2/2000 | Harmon-Weiss et al. | |
| 6,253,466 | B1 | 7/2001 | Harmon-Weiss et al. | |
| 6,453,577 | B1 | 9/2002 | Litchfield et al. | |
| 6,589,614 | B2 | 7/2003 | Stubblefield et al. | |
| 6,694,642 | B2 | 2/2004 | Turner | |
| 6,971,193 | B1 | 12/2005 | Potter et al. | |
| 7,331,124 | B2 * | 2/2008 | Meschan | 36/35 R |
| 7,624,516 | B2 * | 12/2009 | Meschan | 36/35 R |
| 2003/0150133 | A1 | 8/2003 | Staffaroni et al. | |

* cited by examiner

*Primary Examiner* — Marie Patterson
(74) *Attorney, Agent, or Firm* — Martin & Ferraro, LLP

(57) ABSTRACT

A component for supporting a wearer's foot includes a central plate joined at its periphery to one or more tubular portions.

31 Claims, 23 Drawing Sheets

FIG. 6A
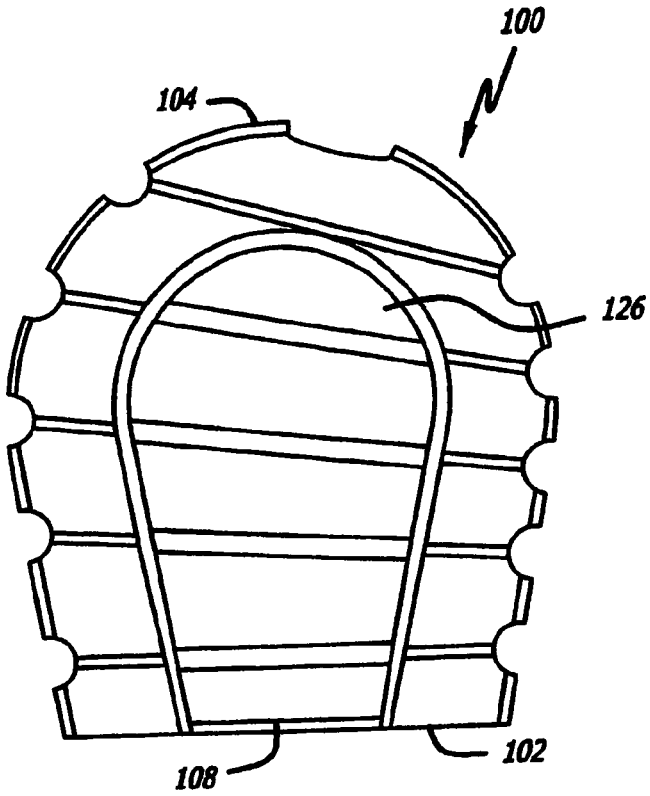
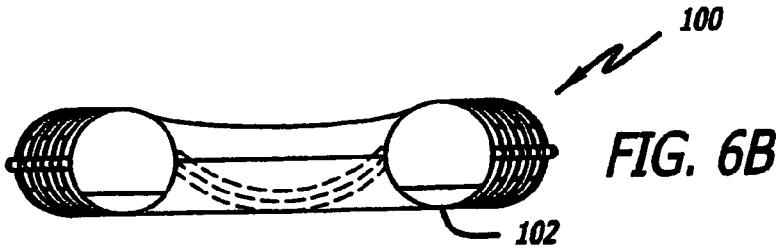
FIG. 6B
FIG. 6C
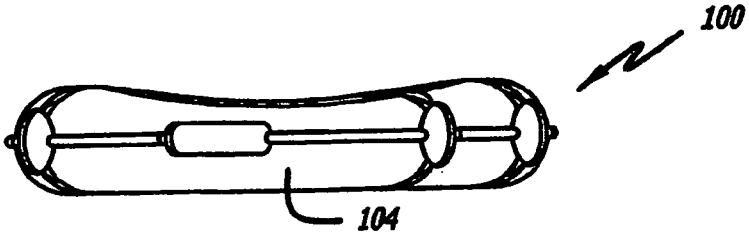
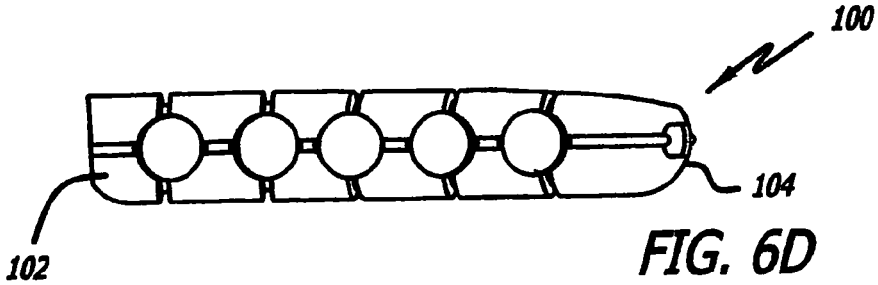
FIG. 6D

FIG. 7
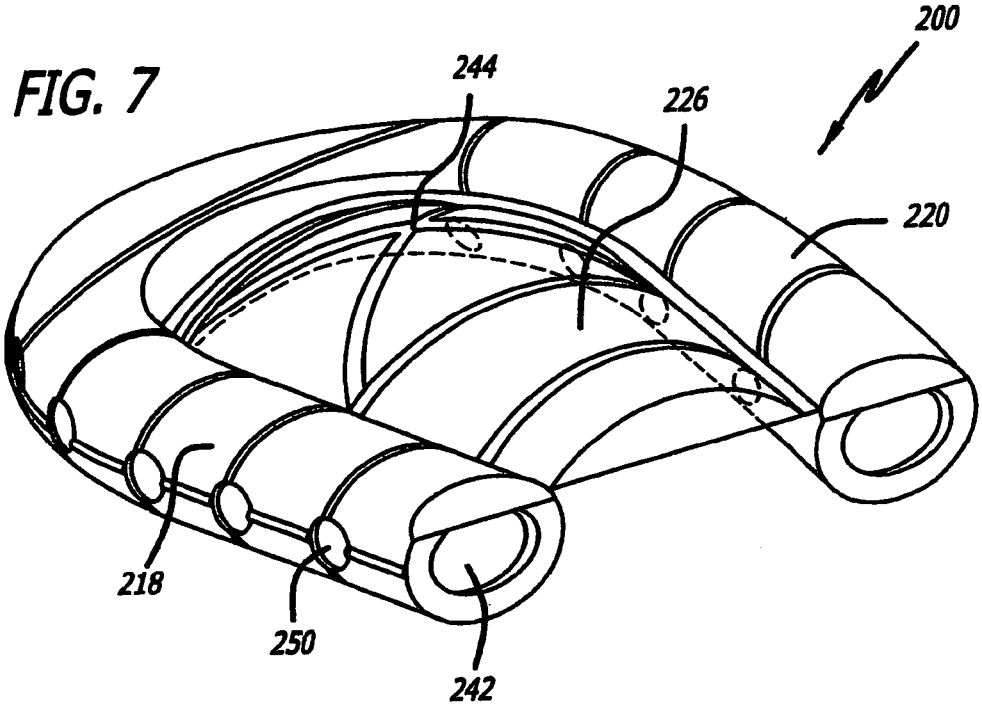
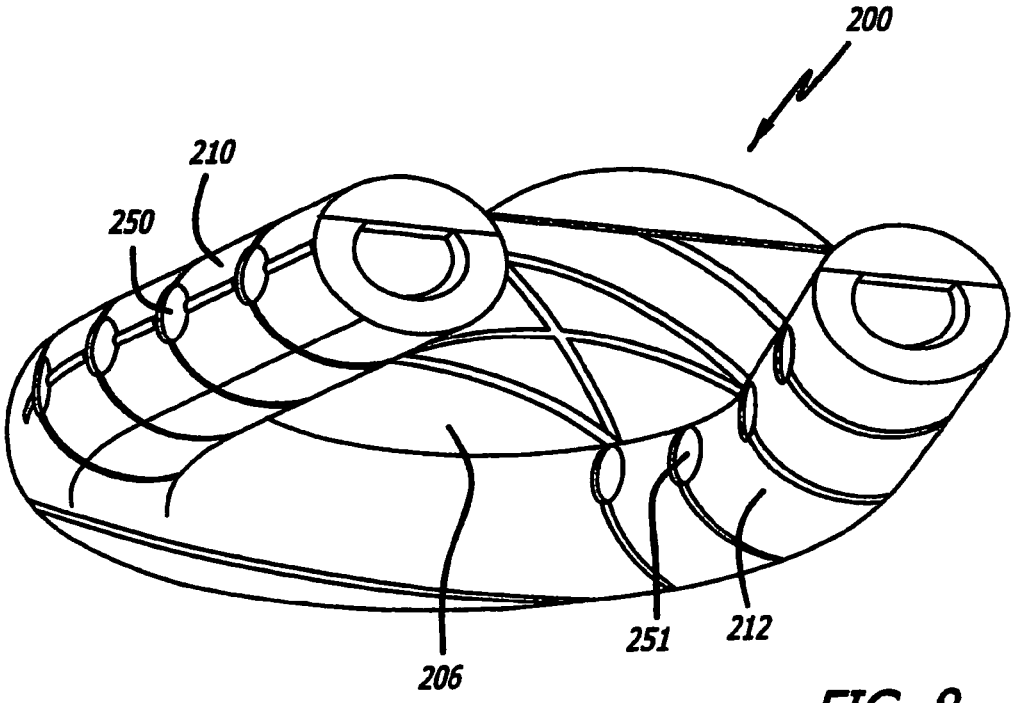
FIG. 8

FIG. 10A
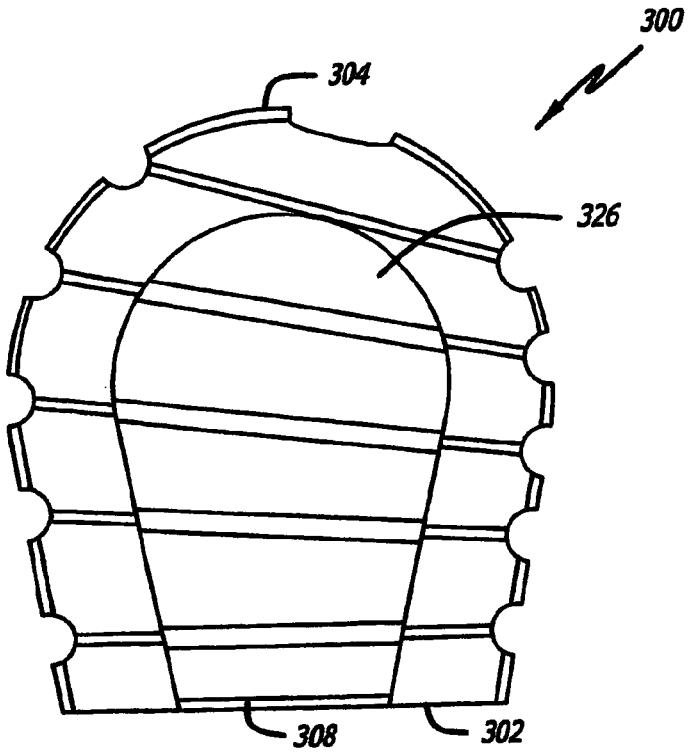
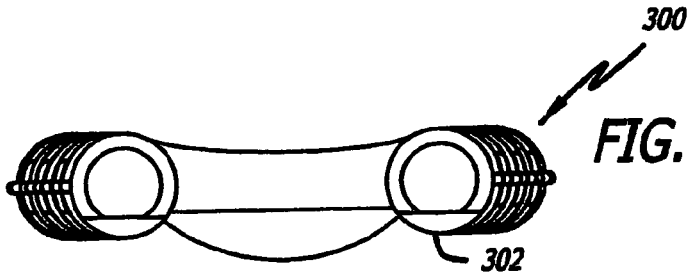
FIG. 10B
FIG. 10C
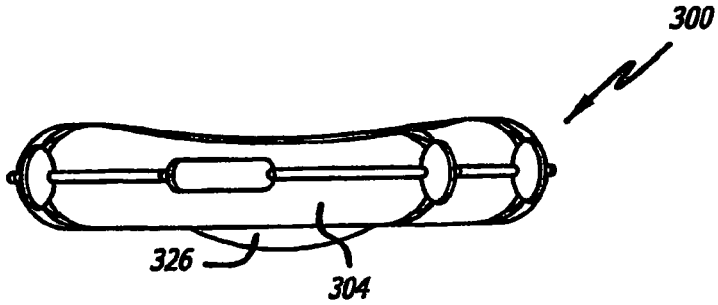
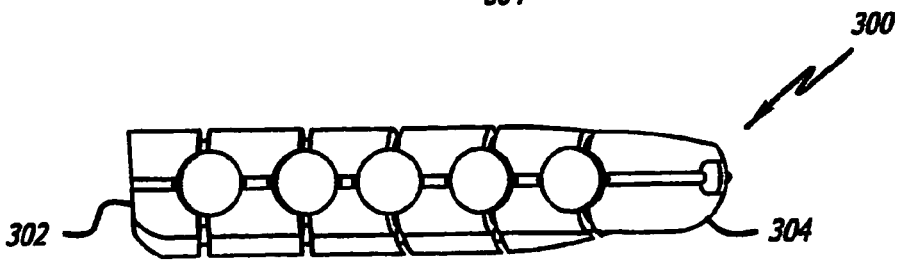
FIG. 10D

FIG. 12A
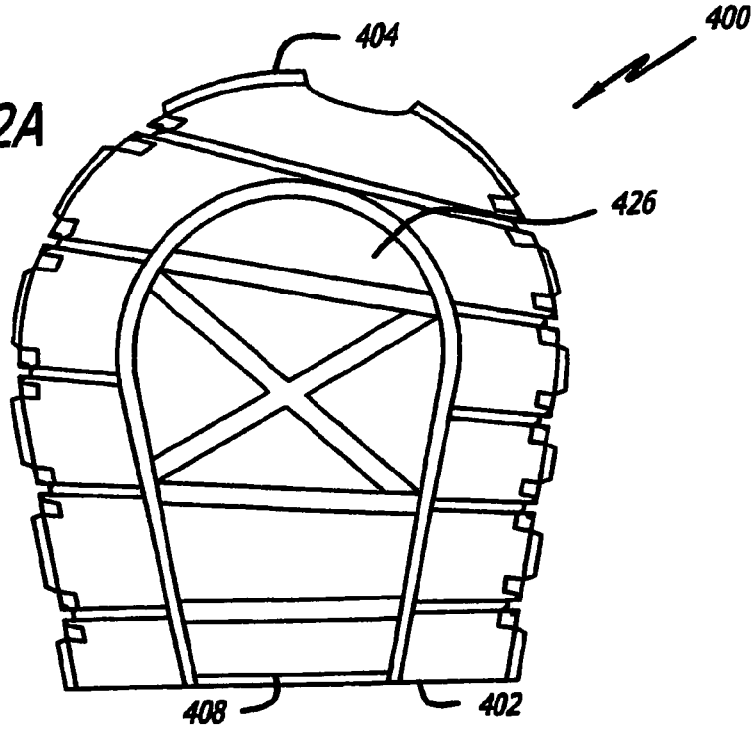
FIG. 12B
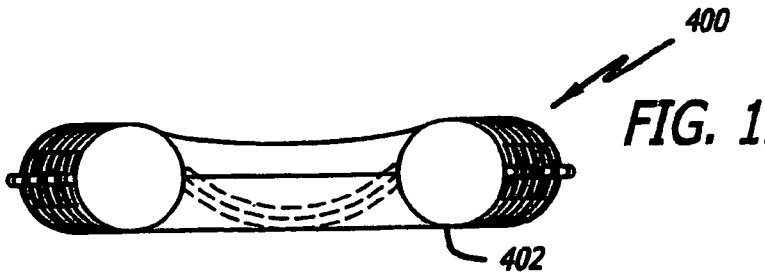
FIG. 12C
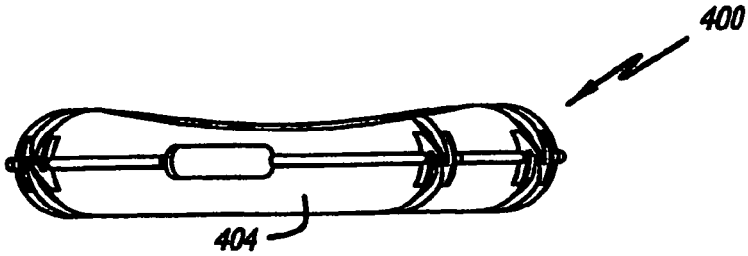
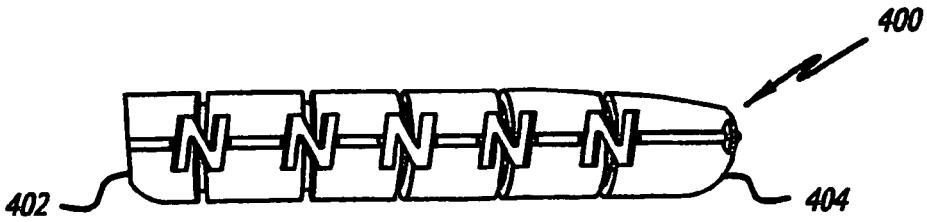
FIG. 12D

COMPONENT FOR USE IN A SHOE

The present application is a continuation-in-part of U.S. application Ser. No. 12/070,143, filed Feb. 15, 2008 now U.S. Pat. No. 7,624,516; which is a continuation of application Ser. No. 10/924,228, filed Aug. 23, 2004 (now U.S. Pat. No. 7,331,124; which claims the benefit of Provisional Application No. 60/497,228, filed Aug. 22, 2003; all of which are incorporated herein by reference.

BACKGROUND OF THE INVENTION

1. Field of the Invention

The present invention relates to a component for placement in a shoe for cushioning and supporting a foot. More particularly, the invention relates to a component for use in a shoe that has tubular portions disposed around a central portion for supporting a region of a foot.

2. Description of the Prior Art

FIG. 1 shows a sole employing a cushion 10 such as disclosed in U.S. Pat. No. 6,253,466, the disclosure of which in incorporated by reference herein. Cushion 10 is part of the midsole, but is partially exposed on its lower side and may contact the ground, thus serving also as an outsole.

The cushion has an outer tubular portion 24 that includes a medial tubular portion 18 and a lateral tubular portion 20, which are formed by resilient load-bearing tubular walls 19. Tubular portions 18 and 20 extend along medial and lateral edges of the foot shape of the sole. Tubular portions 18 and 20 extend generally along the medial and lateral edges of the heel shape part of the foot shape, in the heel region of the sole, opposite from each other with respect to the central portion 26. Tubular portions 18 and 20 also extend along the rear edge 22 of the heel shape, together forming the single, substantially continuous, outer tubular-portion 24. The resulting tubular portion 24 extends in a U-shape substantially continuously along the contour of the heel shape. Walls 19 forming the outer portion 24 are configured and dimensioned such that together with the main sole, walls 19 support edges of a foot and cushion impact produced thereon, for example, by walking, running, or jumping, without collapsing.

A hollow central portion 26 is disposed between and joined with the medial and lateral portions 18 and 20. Central portion 26 is formed by a resilient load-bearing central wall 28, which, as shown in FIG. 2, includes upper and lower wall portions. Central wall 28 is joined to the tubular walls 19 along a portion of its boundary 21, along the entire extent at which central portion 26 lies adjacent tubular portion 24, including on the medial, lateral, and rear sides of central portion 26. Bend sections 23 of the tubular portions 18 and 20 are bent along boundary 21 and have ends facing each other, which are connected. As seen in FIG. 1, bend sections 23 follow the shape of the boundary 21. Central wall 28 is configured and dimensioned for supporting and cushioning a central portion of the foot, in this case of the heel region of the foot, together with the main sole portion, without collapsing.

Cushion 10 also has recessed portions 30 that extend between the central and tubular portions 26 and 24. Recessed portions 30 join the central and tubular portions 26 and 24 while isolating vertical deformation between the sections of tubular walls 19 and central wall 28 that lie adjacent recessed portions 30.

As seen in FIG. 2, tubular walls 19 have vertically spaced elevated sections 32, and central wall has vertically spaced elevated sections 34. Because elevated portions 32 of tubular walls 19 are isolated from elevated portions 34 of central wall 28, substantially no vertical compression is transmitted therebetween across recessed portions 30.

Referring again to FIG. 1, cushion 10 also includes a coupling portion 36 with at least one wall elevated from the level of recessed portions 30, separating recessed portions 30 of cushion 10. Coupling wall 36 connects central elevated sections 34 to tubular elevated sections 32. This connection couples the adjacent elevated sections 32 and 34 such that vertical deformation is transmitted between tubular walls 19 and central wall 28.

Coupling portion 36 permits energy to be stored, absorbed, and returned to the foot by both central walls 28 and tubular walls 18 and 20 when cushion 10 is impacted in locations on either the central or tubular portions 26, 18, or 20 that are near coupling portion 36. Coupling portion 36 is disposed at the rear of the heel, generally aligned with a heel strike area 52.

It is well known in the art that during a step, particularly while a wearer is running, the wearer's foot strikes the sole generally along a strike path 66, shown in FIG. 1. The strike path 66 along the sole extends from the heel to the fore foot portion of the sole. This path 66 receives first and largest loads from impact on the sole.

The cushion is shown in FIG. 1 is disposed in the sole such that the heel strike area is disposed in the region defined behind lines 54 and 56. If cushion 10 is sized for a men's size 9.5 shoe, lines 54 and 56 intersect centerline 38 of cushion 10 at about 23 to 31 mm from the rear of cushion 10. Line 54 extends laterally at an angle 58 of about 25 degrees forward from a horizontal line 60 normal to the centerline 38. Line 56 extends medially at an angle 62 of about 5 degrees behind line 60. Thus, the coupling portion 36, being disposed generally centrally with respect to the heel strike area 52, is displaced laterally from the centerline 38.

Because central and tubular portions 26 and 24 are hollow, central portion 26 defines a central interior chamber 40, and tubular portion 24 defines a tubular interior chamber 42. Central interior chamber 40 extends substantially across the middle of the cushion. Central and tubular chambers 40 and 42 are communicated through the interior of coupling portion 36. Tubular and central walls 19 and 28 are coupled for transmitting vertical deformation therebetween where coupling portion 36 communicates interior chambers 40 and 42.

Central and tubular walls 28 and 19 also have stiffening ribs 44 that extend widthwise across central and tubular portions 26 and 24. As walls 19 and 28 of cushion 10 are of substantially uniform thickness, ribs 44 form grooves 46 on an opposite side of walls 19 and 28 therefrom. Ribs 44 increase the bending stiffness of walls 19 and 28.

As shown in FIG. 1, the bottom central wall 28 preferably includes an indented portion 64 that has substantially the same depth as ribs 44. Indented portion 64 may display decorative or trade insignia.

The cross-sectional shape of cushion 10 taken along plane II-II of FIG. 1, which extends widthwise and vertically through cushion 10, is best shown in FIG. 2. Both central and tubular walls 28 and 19 have an arcuate shape. Central wall 28 defines an oval cross-section.

The cross-sections of tubular walls 19 are generally circular when compared to the cross-section of central wall 28. Due to these shapes, cushion 10 stores and returns energy to a wearer. The relatively wide and horizontal elevated portions 34 of central walls 28 renders the central portion less stiff than tubular portion 24. At the widest part of the cushion 10, which is shaped for a heel, central portion 26 reaches a maximum width 74 that is greater than about 50% of the maximum width 84 of cushion 10 from the medial edge of the medial tubular portion 18 to the lateral edge of the lateral tubular portion 20. One of the medial and lateral tubular portions 18 and 20 is at least about 15% as wide as central portion 26 where cushion 10 is widest. Central and tubular portions 26 and 24 have substantially the same vertical height 72.

While the cushion described above exhibits satisfactory shock absorbing characteristics, there exists a need for an improved cushion that provides comparable to superior shock absorbing qualities at a reduced weight.

SUMMARY OF THE INVENTION

In one preferred embodiment of the present invention a component for use in a shoe is provided. The component includes first and second tubular portions having, respectively, resilient load-bearing first and second hollow tubular walls. One of the walls has a shape for extending generally along a lateral side of a wearer's foot and the other of the walls has a shape for extending generally along a medial side of the wearer's foot. The tubular walls have a thickness, material, and shape providing sufficient strength for supporting and cushioning of at least a portion of the lateral side and medial side of the wearer's foot. The tubular walls have an exterior surface with an outwardly oriented portion and an inwardly oriented portion, the inwardly oriented portion of the first and second tubular walls being oriented generally toward one another. At least one of the first and second tubular walls has a hole through at least one of the outwardly oriented portion and the inwardly oriented portion. The component further includes a central portion having a load-bearing central surface disposed between and joined with the first and second tubular portions. The central portion has a strength for supporting and cushioning a width-wise central part of the foot. The central portion does not form a portion of an air-tight enclosure.

In another preferred embodiment of the present invention, the at least one hole is through the outwardly oriented portion of at least one of the first and second tubular walls.

In another preferred embodiment of the present invention, the at least one hole is through the inwardly oriented portion of at least one of the first and second tubular walls.

The present invention provides for one or more of the following advantages over the prior art. The over-all weight of the shoe is reduced as a result of a reduction in the amount of material used to make the component, both in the tubular portions because of the at least one hole and in the central portion because the air trapping lower wall portion is eliminated. The cushioning properties are enhanced by an improved upper wall without the need for trapped air. The costs of manufacturing are reduced in part due to the reduction of materials required to construct the component as well as the substantial reduction or elimination of any need for the incorporation of air-tight enclosures containing trapped air or other shock-absorbing substances in the rear sole of the shoe. These and other advantages of the present invention, including without limitation optional ribs located either in the tubular portions or beneath the lower surface of the central portion, will be apparent from review of the following specification and the accompanying drawings.

BRIEF DESCRIPTION OF THE DRAWINGS

FIG. 6A is a bottom view of the component of FIG. 3.

FIG. 6B is a front elevation view of the component of FIG. 3 rotated 180 degrees about its axis.

FIG. 6C is a rear elevation view of the component of FIG. 3 rotated 180 degrees about its axis.

FIG. 6D is a side elevation view of the component of FIG. 3 rotated 180 degrees about its axis.

FIG. 7 is a top perspective view of a component in accordance with another preferred embodiment of the present invention.

FIG. 8 is a bottom perspective view of the component of FIG. 7.

FIG. 10A is a bottom plan view of the component of FIG. 9A.

FIG. 10B is a front elevation view of the component of FIG. 9A rotated 180 degrees about its axis.

FIG. 10C is a rear elevation view of the component of FIG. 9A rotated 180 degrees about its axis.

FIG. 10D is a side elevation view of the component of FIG. 9A rotated 180 degrees about its axis.

FIG. 12A is a bottom plan view of the component of FIG. 11A.

FIG. 12B is a front elevation view of the component of FIG. 11A rotated 180 degrees about its axis.

FIG. 12C is a rear elevation view of the component of FIG. 11A rotated 180 degrees about is axis.

FIG. 12D is a side elevation view of the component of FIG. 11A rotated 180 degrees about its axis.

DETAILED DESCRIPTION OF THE PREFERRED EMBODIMENT

Figure 1:
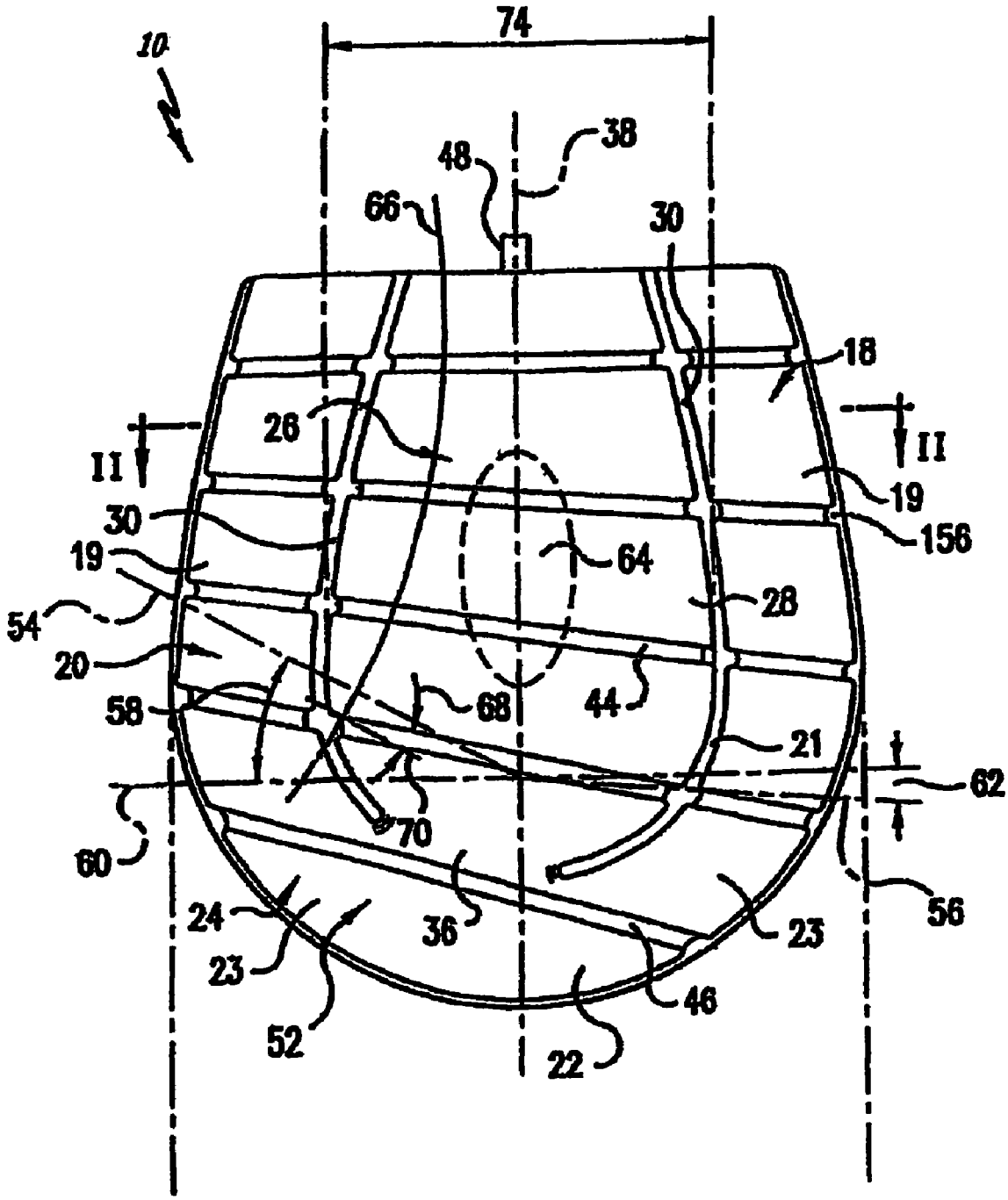
FIG. 1 PRIOR ART
FIG. 1 is a top plan view of a cushion of the prior art.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims. Wherever possible, the same reference numbers will be used throughout the drawings to refer to the same or like parts.

FIGS. 3 to 6D show a preferred embodiment of a component 100 in accordance with the present invention. Component 100 includes a front 102, a rear 104, a first tubular portion 118, a second tubular portion 120, and a central portion 126 having a central wall 128 between first and second tubular portions 118, 120. Central portion 126 is preferably a flexible plate that is capable of deflecting vertically relative to first and second tubular portions 118, 120. Examples of flexible plates suitable for footwear are taught by Meschan in U.S. Pat. Nos. 5,560,126; 5,918,384; and 5,806,210, the disclosures of which are incorporated herein by reference.

Central portion 126 has an upper surface that is preferably convex and a lower surface 106 that is preferably concave. In a preferred embodiment, central portion 126 resembles a half clamshell and functions similarly to a trampoline to provide shock absorbing qualities to the shoe. The front of central portion 126 includes a wall 108 that provides additional stability to central portion 126. It will be appreciated that central portion 126 may still provide sufficient shock absorbing qualities without the presence of wall 108. Additionally, it will be appreciated that central plate wall 128 may be flat or contain an indentation or central concave portion, such as shown in FIG. 18 of U.S. Pat. No. 5,918,384, to guide a wearer's heel during downward movement of central portion 126.

Figure 2:
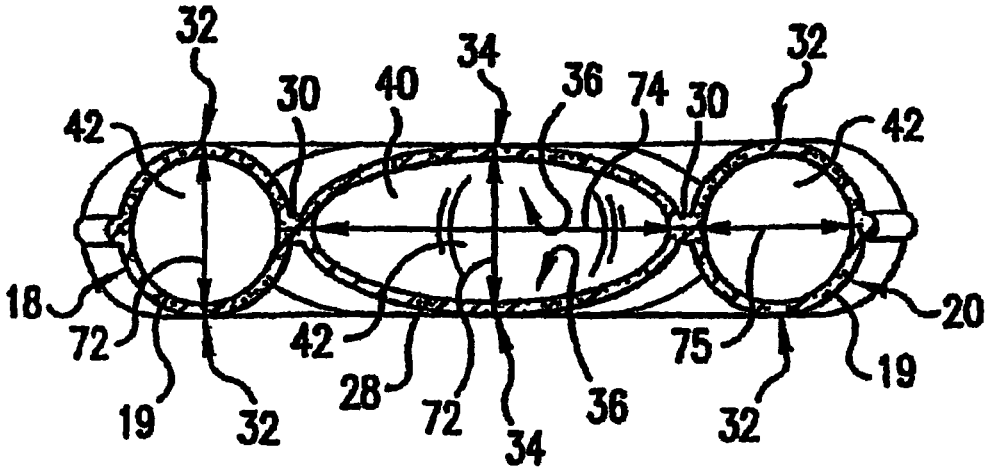
FIG.2 PRIOR ART
FIG. 2 is a cross-sectional front view of the cushion of FIG. 1 along plane II-II of FIG. 1.
Figure 3:
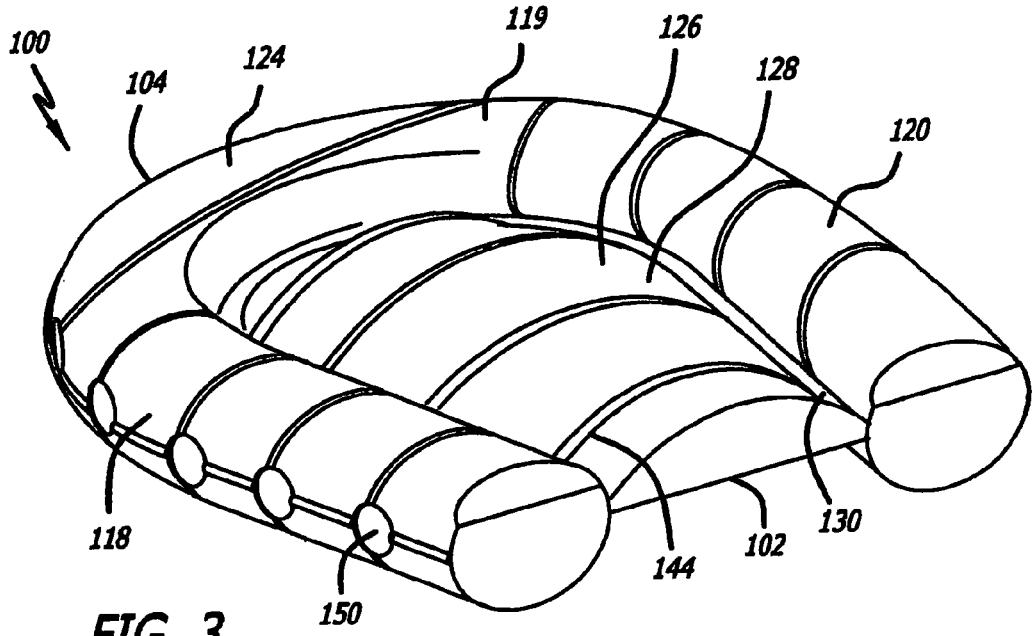
FIG. 3 is a top perspective view of a component in accordance with a preferred embodiment of the present invention.
Figure 4:
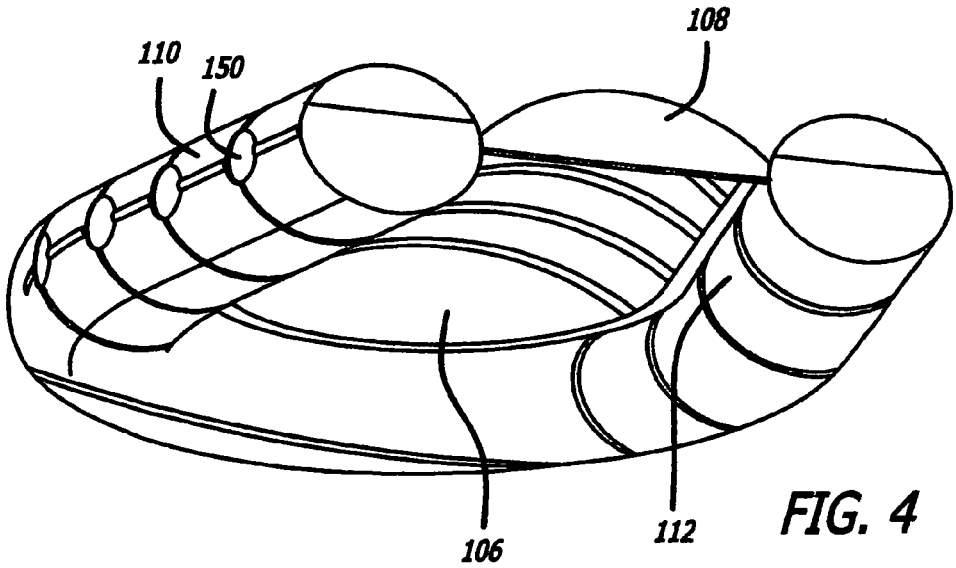
FIG. 4 is a bottom perspective view of the component of FIG. 3.

The central portion 126 of component 100 preferably includes a plurality of stiffening ribs 144 arranged generally parallel to one another and extending from side to side along the width of the central portion. Preferably, ribs 144 extend across the entire width of central portion 126 and may extend around a substantial portion of the entire exterior surface of each tubular portion. They may also extend around the entire exterior surface of the tubular portions. First and second tubular portions 118, 120 each include a circumferential wall 124 and have an outwardly oriented portion 110 and an inwardly oriented portion 112. As shown in FIG. 2, the inwardly oriented portions of first and second tubular portions 118, 120 are preferably oriented toward one another. First and second tubular portions 118, 120 are preferably hollow. It will be appreciated that the cross section of outer tubular portions 118, 120 may take a variety of shapes without deviating from the scope of the present invention. For example, first and second outer tubular portions may be circular or oval-shaped.

Figure 5A:
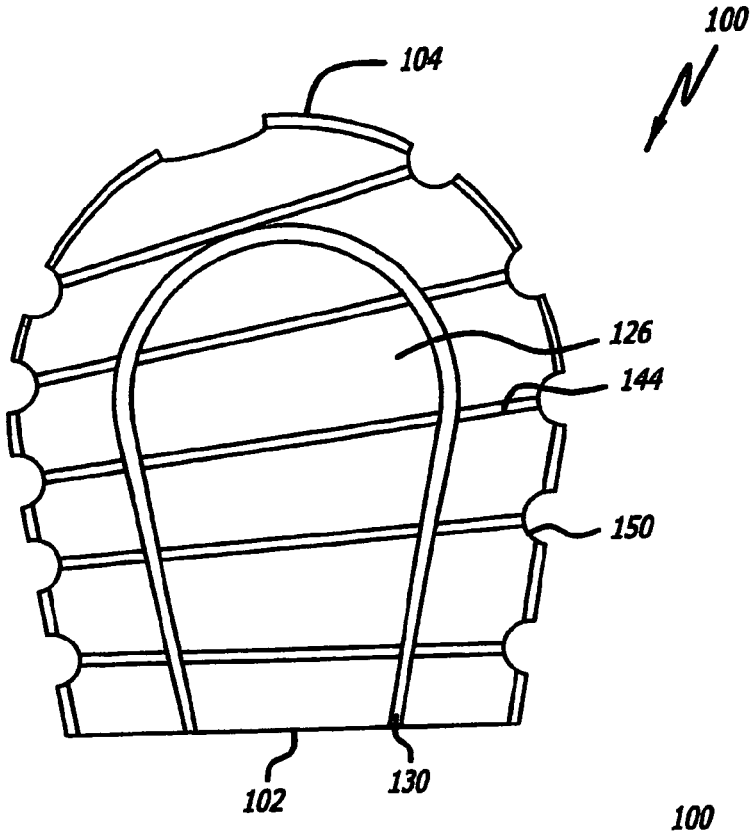
FIG. 5A is a top plan view of the component of FIG. 3.
Figure 5B:
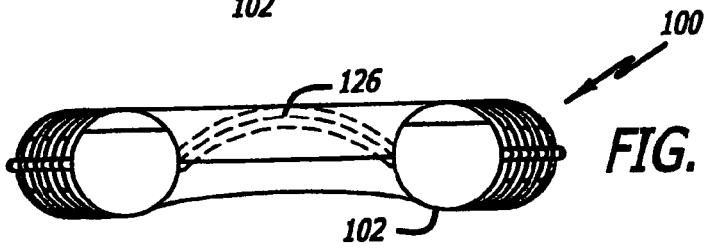
FIG. 5B is a front elevation view of the component of FIG. 3.
Figure 5C:
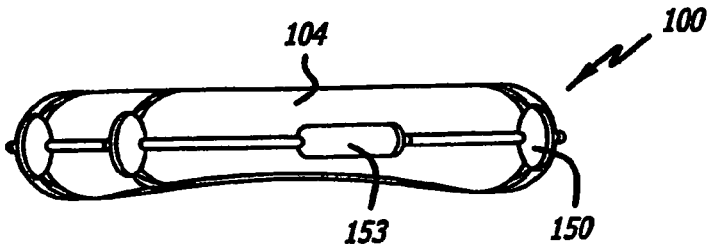
FIG. 5C is a rear elevation view of the component of FIG. 3.
Figure 5D:
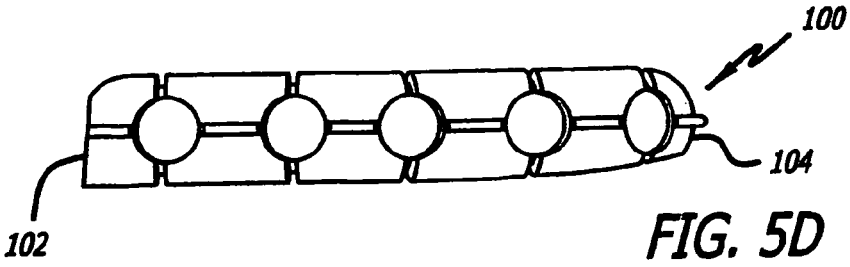
FIG. 5D is a side elevation view of the component of FIG. 3.
Figure 9A:
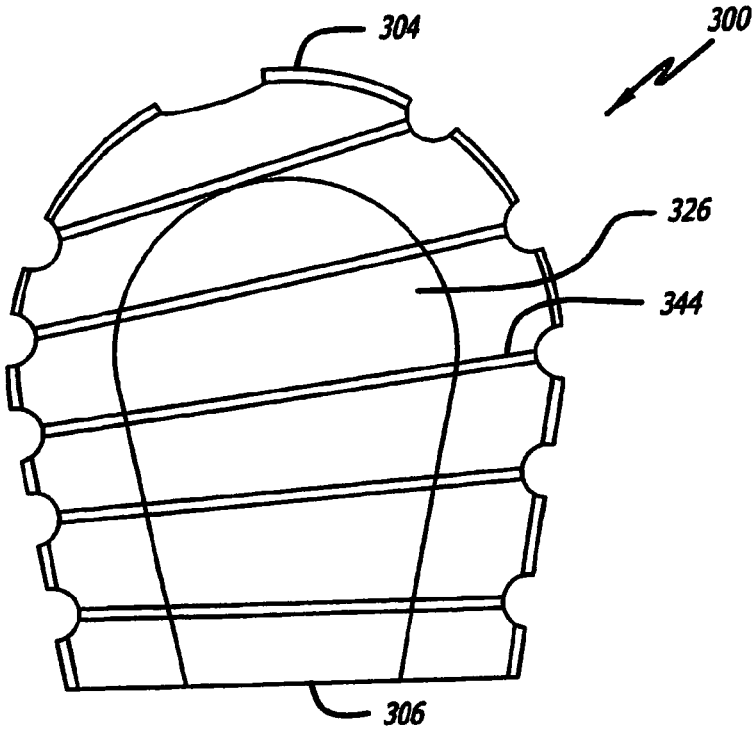
FIG. 9A is a top plan view of a component in accordance with a further preferred embodiment of the present invention.
Figure 9B:
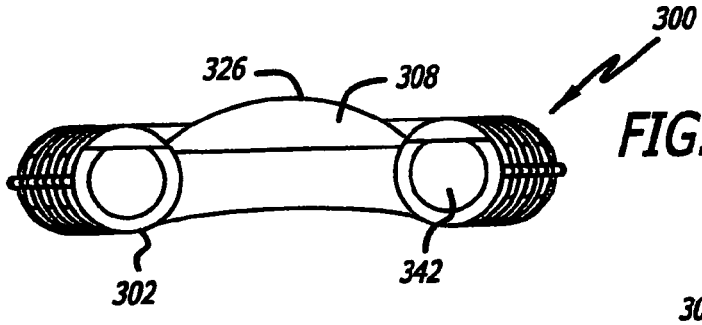
FIG. 9B is a front elevation view of the component of FIG. 9A.
Figure 9C:
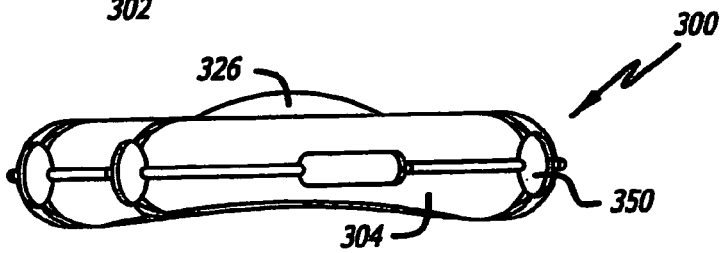
FIG. 9C is a rear elevation view of the component of FIG. 9A.
Figure 9D:
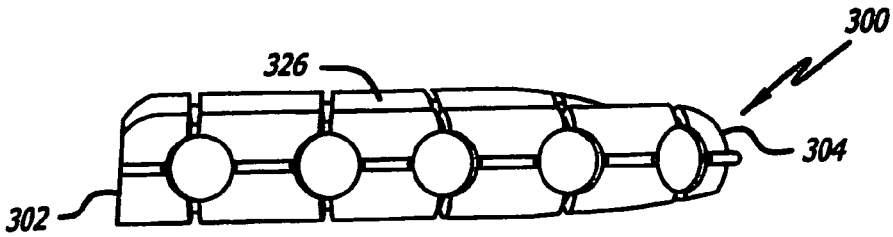
FIG. 9D is a side elevation view of the component of FIG. 9A.
Figure 11A:
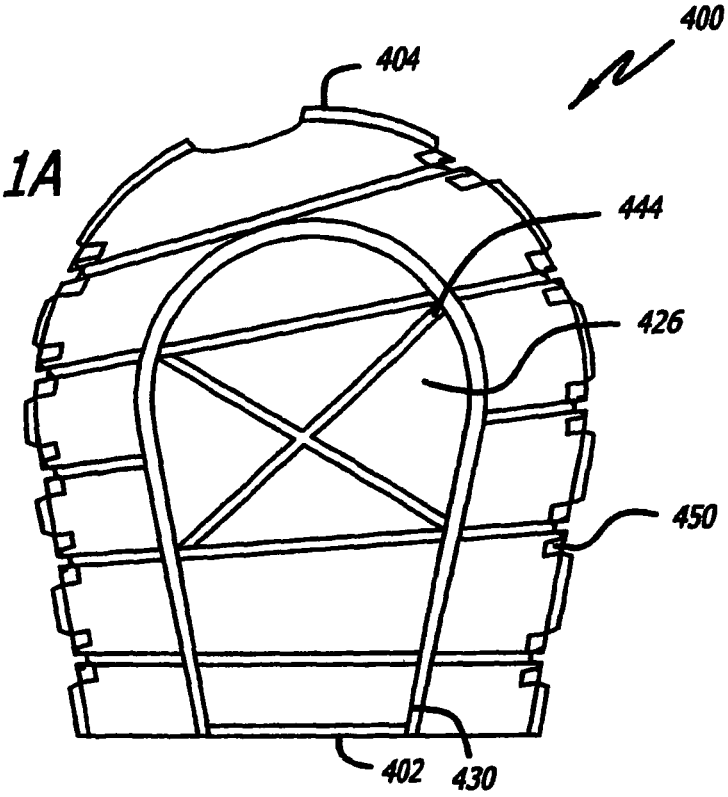
FIG. 11A is a top plan view of a component in accordance with an additional preferred embodiment of the present invention.
Figure 11B:
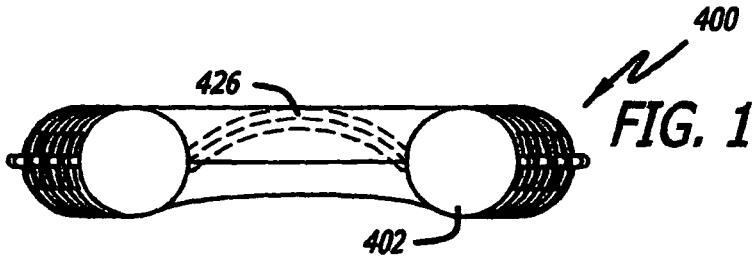
FIG. 11B is a front elevation view of the component of FIG. 11A.
Figure 11C:
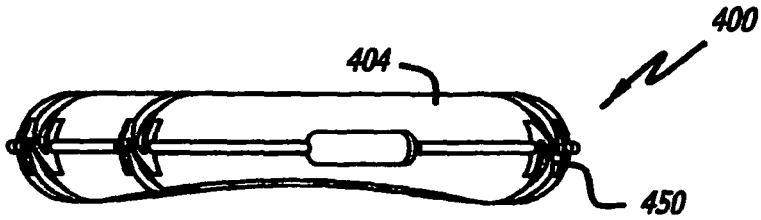
FIG. 11C is a rear elevation view of the component of FIG. 11A.
Figure 11D:
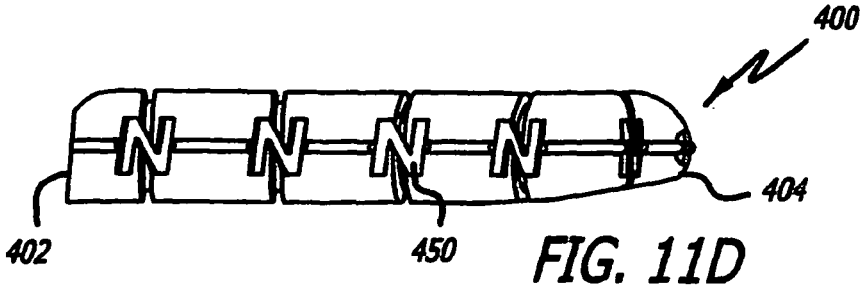
FIG. 11D is a side elevation view of the component of FIG. 11A.

Outwardly oriented portion 110 of each tubular portion includes at least one opening 150 therethrough leading to the hollow interior of each tubular portion. Openings 150 may be positioned to intersect with ribs 144 to produce maximum cushioning. The cushioning may be adjusted by positioning one or more of openings 150 to be off-set from the ribs. Openings 150 may be circular, semicircular, elliptical, polygonal, trapezoidical, or any shape that is suitable for the intended purpose. For example, as shown in FIG. 5C, opening 153 in rear end 102 is generally elliptical to correspond to the reduced height at rear end 102 of component 100. The size of the openings may be uniform or may vary depending upon the location of the openings. Including at least one opening provides the advantages of reducing overall weight, enhancing springiness, and reducing material costs. Additionally, through-openings may be included in central portion 126, similar to those shown in FIG. 28 of U.S. Pat. No. 5,560,126. Such holes may or may not allow air communication between the outside of the shoe (through the bottom of the shoe) and an interior portion of the shoe.

In FIGS. 7 and 8, another preferred embodiment of the component of the present invention is shown and generally referred to by the reference number 200. Component 200 is similar to component 100, but the region of intersection between central portion 226 and first and second tubular portions 218, 220 is more elevated relative to a mid-horizontal plane of component 200. Preferably, the region of intersection between central portion 226 and first and second portions 218, 220 is in the upper one-third of the maximum height of the outer tubular portions.

As shown in FIG. 8, the elevated height of central portion 226 allows for the provision of one or more openings 251 in inwardly oriented portions 212 of first and second tubular portions 218, 220 that lead to hollow interior 242. Openings 251 may be oriented such that they align with openings 250 of outwardly oriented portions 210. Alternatively, openings 251 may be off-set from openings 250. As will be appreciated, the shape, number, and placement of the openings may be varied while still being within the scope of the present invention.

As shown in FIGS. 7 and 8, ribs 244 are preferably arranged to intersect below the approximate center of the calcaneus of the wearer to provide increased stability and/or springiness where it is most needed. It will be appreciated that the ribs may intersect at other locations as well. Further, the angle of intersection between the intersecting ribs may vary without departing from the scope of the present invention. A network of intersecting ribs may be provided, or a pattern of intersecting ribs interspaced with non-intersecting ribs. The ribs themselves can vary in thickness and cross-sectional shape. For example, the cross-sectional shape of the ribs may include an arcuate shape or triangular shape. The rib thickness may vary across the width and/or from rib to rib along the length of the component.

In FIGS. 9A to 10D, another preferred embodiment of the component of the present invention is shown and generally referred to by the reference number 300. Component 300 is similar to component 200, but ribs 344 are generally parallel to one another.

In FIGS. 11A to 12D, another preferred embodiment of the component of the present invention is shown and generally referred to by the reference number 400. Component 400 is similar to component 100, but at least two ribs 444 intersect one another in a manner such as described above in relation to component 200. Further, openings 450 are stylized with an "N" shape, to correspond to a well know logo. It will be appreciated that the openings may have other shapes corresponding to a different logo if so desired, while at the same time achieving the goals of additional cushioning and weight reduction.

Figure 13:
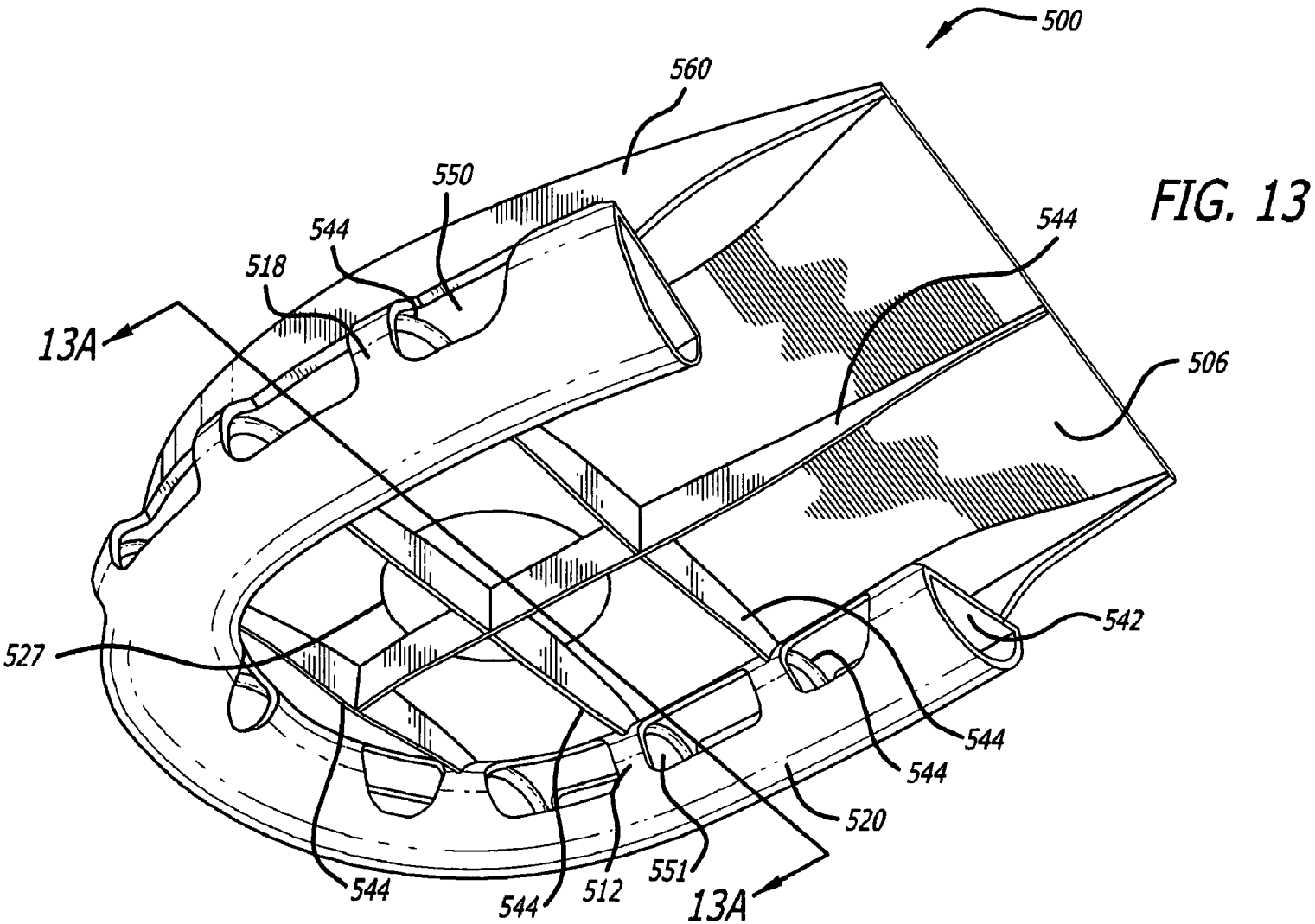
FIG. 13 is a right-side front bottom perspective view of a component for use in a shoe in accordance with yet another preferred embodiment of the present invention.
Figure 13A:
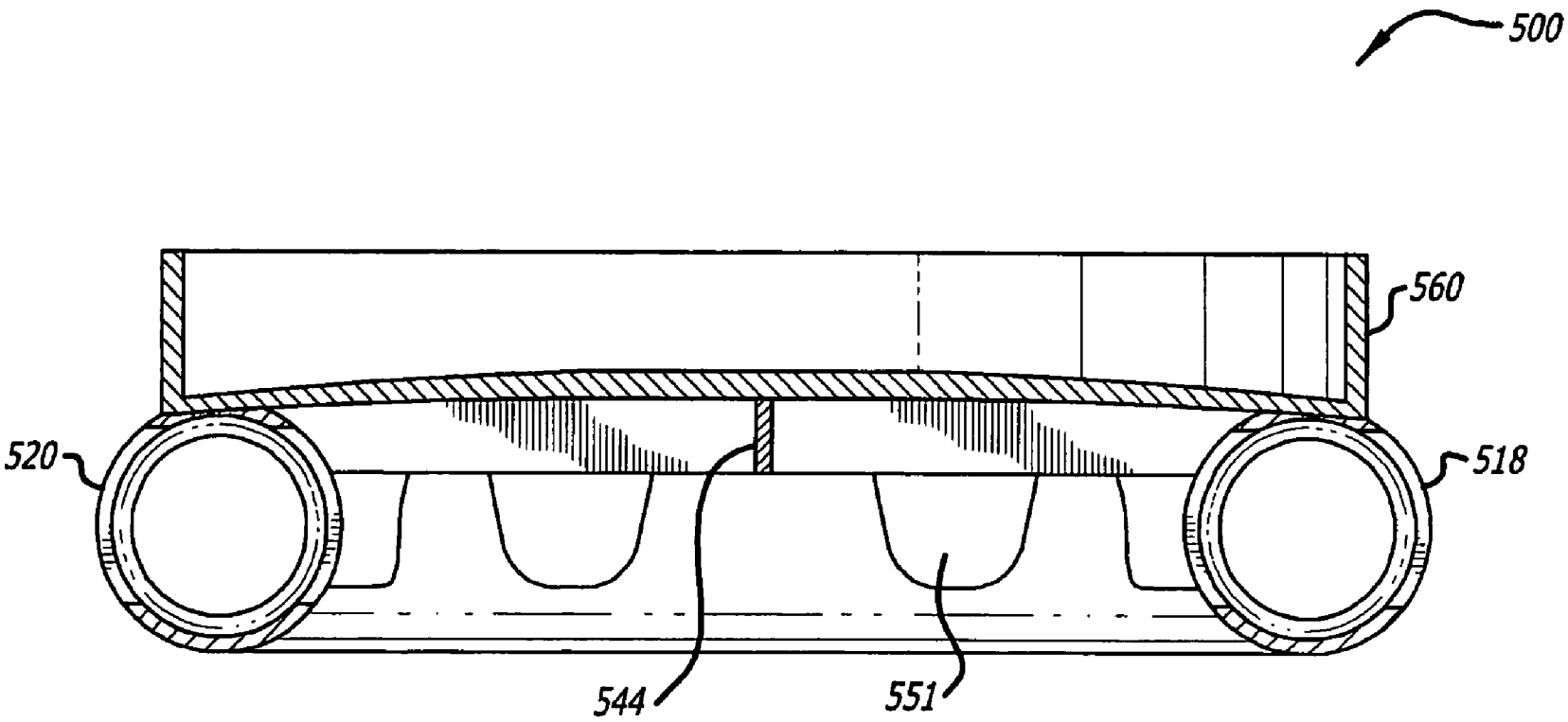
FIG. 13A is a cross-sectional front view of the component of FIG. 13 along plane 13A-13A of FIG. 13.
Figure 13B:
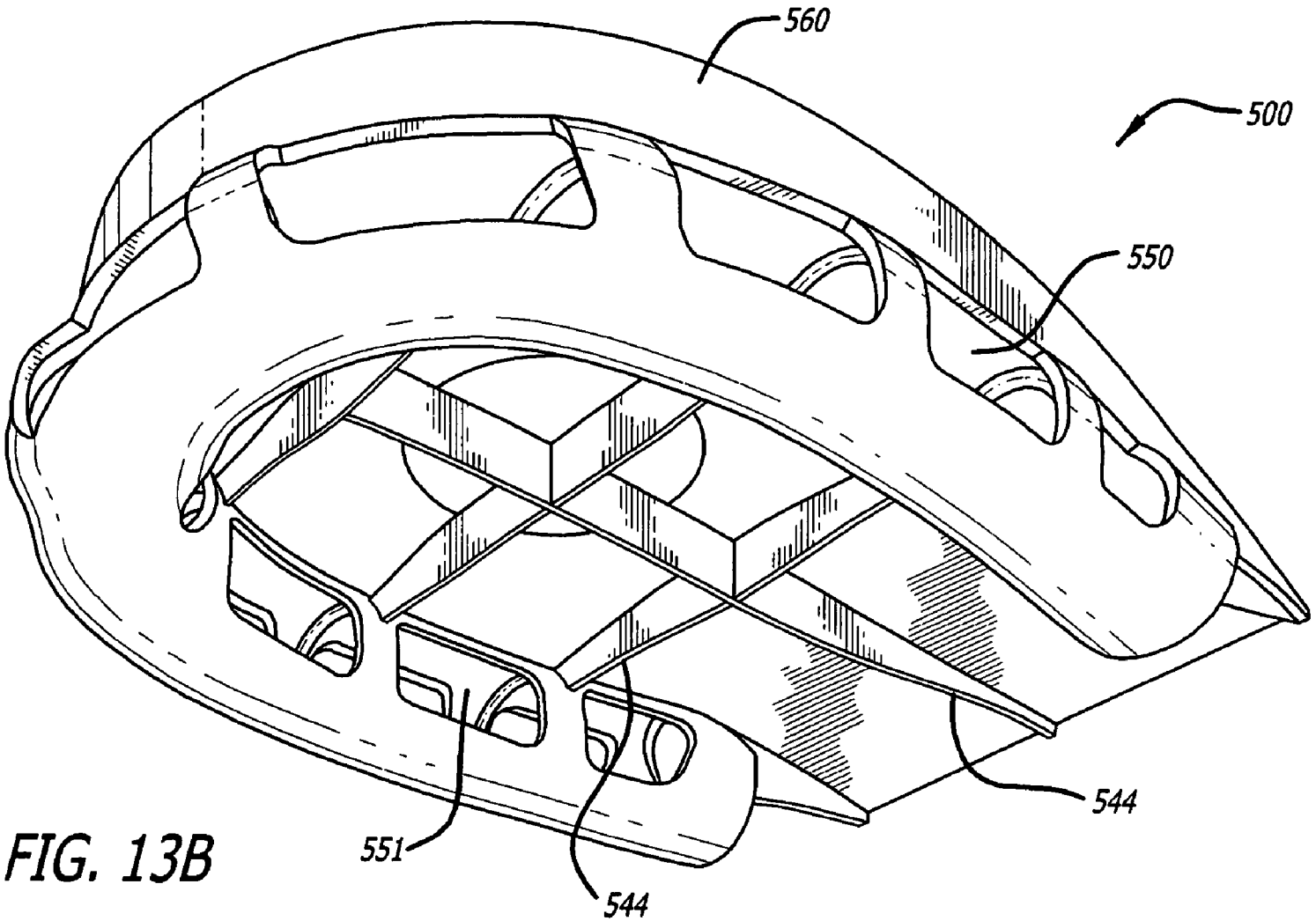
FIG. 13B is a right-side rear bottom perspective view of the component of FIG. 13.
Figure 13C:
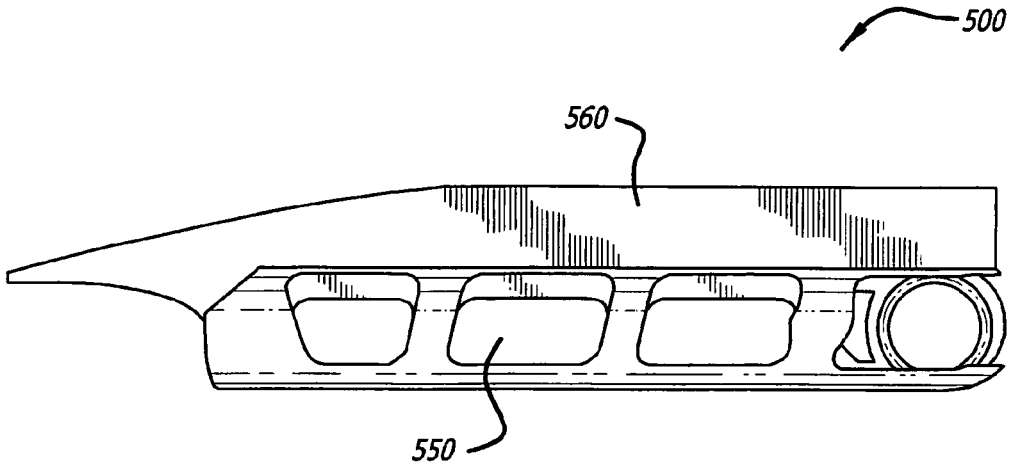
FIG. 13C is a left-side elevation view of the component of FIG. 13.
Figure 13D:
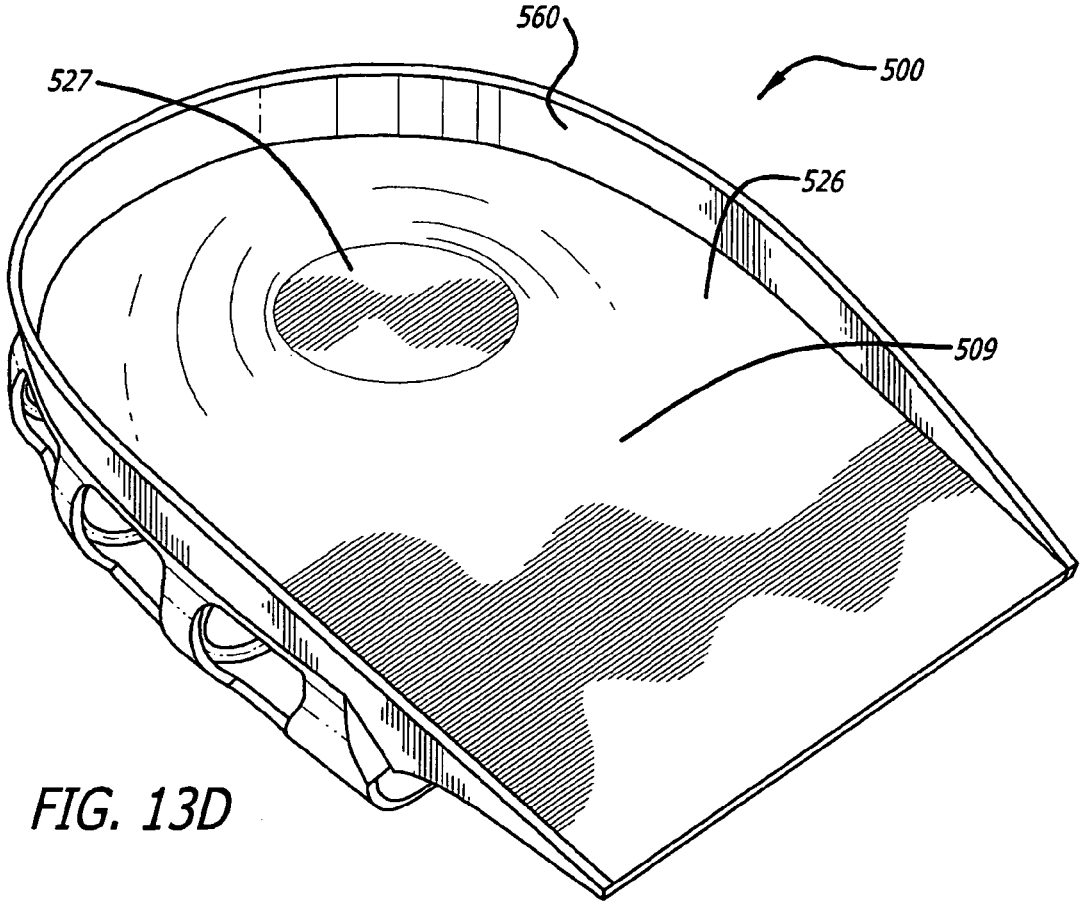
FIG. 13D is a right-side front top perspective view of the component of FIG. 13.

In FIGS. 13 to 13D, yet another preferred embodiment of a component for use in a shoe of the present invention is shown and generally referred to by the reference number 500. Component 500 is similar to component 200, in that ribs 544, if employed, may intersect one another in a manner such as described above in relation to component 200. In particular, lower surface 506 of central portion 526 may have a plurality of side-to-side ribs 544 intersected by another rib 544 that runs generally along a mid-longitudinal axis of component 500. Ribs 544 are preferably taller than wide, and ribs 544 in this embodiment may vary in height along the length of ribs 544. Side-to-side ribs 544 may have a generally arcuate upper surface 509 matching the generally concave curvature of the adjacent portion of lower surface 506, but such upper surface may also be flat (not shown), to match a flat adjacent lower surface (not shown). Central portion 526 preferably has a middle portion 527 along the mid-longitudinal axis of component 500 under the wearer's heel that is generally flat. In particular, as shown in FIG. 13D, upper surface 509 of central portion 526 is generally convex from side to side and forward to rear except for mid-portion 527 that is generally flat. Ribs 544 of the embodiment of the invention shown in FIGS. 13 to 13D extend across a substantial portion of the lower surface of central portion 526 of component 500 and around at least a substantial portion of the interior circumference of tubular portions 518, 520. Preferably, ribs 544, if utilized, are integrally formed with central portion 526. Ribs 526 inside tubular portions 518, 520, if utilized, are also preferably integrally formed with the interior of tubular portions 518, 520.

Optional ribs 544 of interior 542 of tubular portions 518, 520 are utilized to increase the stiffness of tubular portions 518, 520 if desired. At least some of ribs 544 on interior 542 of tubular portions 518, 520 may be aligned with ribs 544 on lower surface 506 of central portion 526 for added peripheral resistance to deflection if desired. Tubular portions 518, 520 may vary in cross-sectional size and shape along its length, or be substantially uniform in cross-sectional size and shape, whichever may be better to enhance heel-to-toe transition and/or improve "ride" in a particular model of shoe. Tubular portions 518, 520 may be formed of a different material on the medial side of component 500 than on the lateral side of component 500 to give the component different stiffness or durometer on the medial side than on the lateral side. Alternatively, the different stiffness or durometer can be achieved by having a different material thickness or size and number of openings 550, 551 as between the medial side and the lateral side. Either of these techniques may be used, for example, to reduce or eliminate excessive pronation or supination of the user, as the case may be. The material used to form tubular portions 518, 520 may be translucent to permit one to see the configuration of the technology contained with component 500.

Openings 550, 551 are larger than those depicted in previous embodiments. Openings 550, 551 in the sidewalls of the tubular portions as viewed in a horizontal plane passing through the middle of the majority of openings 550, 551 may occupy more area than the material of the sidewalls of the tubular portions 518, 520, in homage to the goals of weight reduction and/or increased visibility.

Further, component 500 may include a heel counter 560 that is preferably integrally formed with either a peripheral portion of central portion 526 or with tubular portions 518, 520. Preferably, heel counter 560 and central portion 526 have the same stiffness as one another, but different from the stiffness of tubular portions 518, 520.

Because of the stiffening of central portion 526 via ribs 544, central portion 526 moves vertically in a generally piston-like manner, forcing tubular portions 518, 520 to deflect. In an alternative embodiment, where the ribs are smaller then those shown in FIGS. 13-13D or if the ribs taper toward the center, central portion 526 may deflect to some degree in a trampoline like manner. Component 500 is permanently attached as a component of a conventional shoe, and preferably may be used as a principal component of the rear midsole of a shoe. Component 500 can be made as a foamless midsole component capable of reducing the weight of a shoe by incorporating this technology. Further, outsole material may be directly and permanently attached by adhesive and/or other means to the bottom surface of tubular portions 518, 520. A shoe including component 500 may include a removable or non-removable sock liner. In either case, the lower surface of the portion of the sock liner directly above the component may conform to the shape of the upper surface of the tubular portions 518, 520 and or central portion 526. If desired, a relatively thin foam cushion (not shown) may be utilized between the component and a shoe upper. The foam cushion has a lower surface conforming to the shape of the tubular portions and/or central portion and an upper surface conforming to the shape of the lower surface of the upper.

Figure 14:
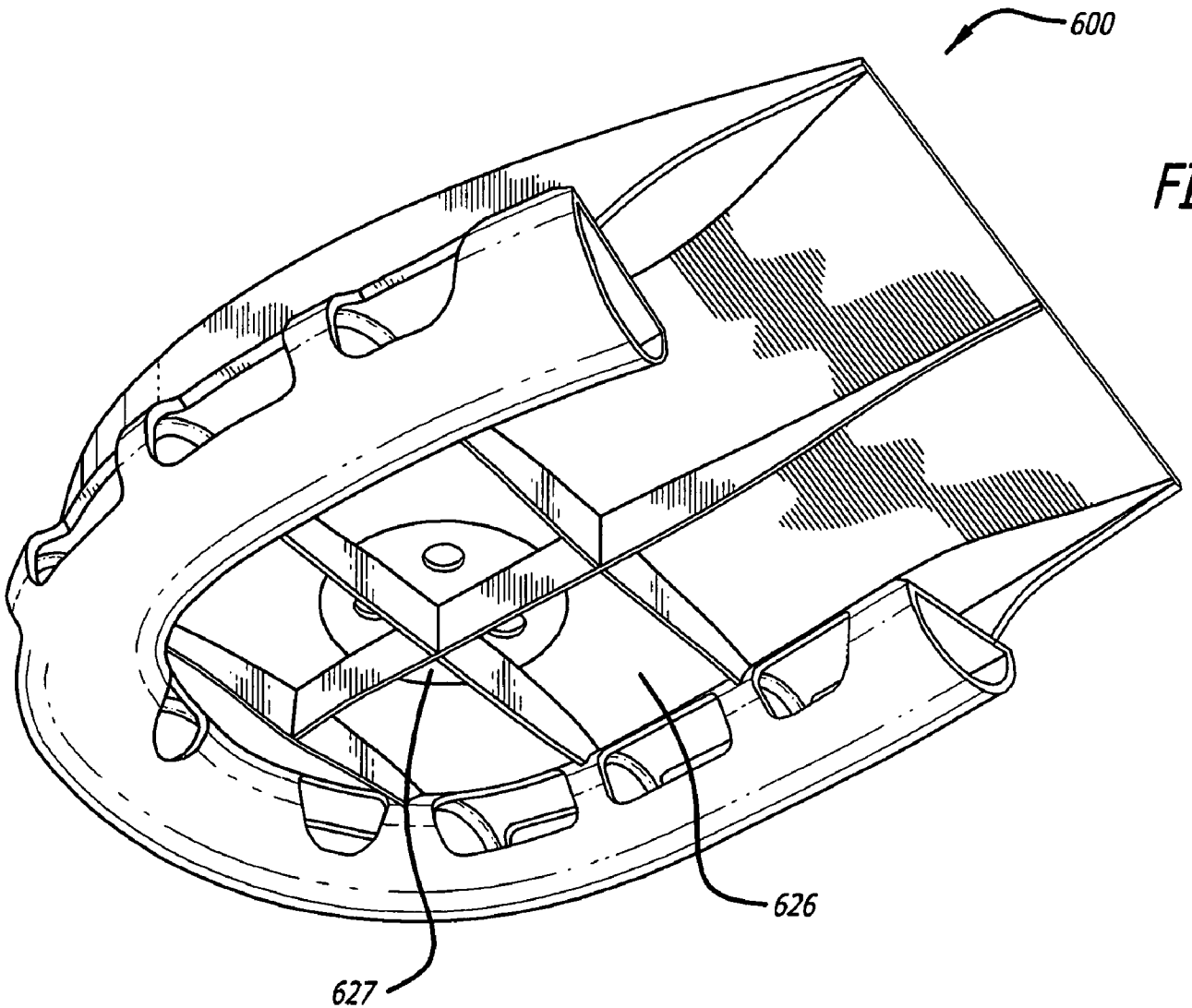
FIG. 14 is a right-side front bottom perspective view of a component for use in a shoe in accordance with yet a further preferred embodiment of the present invention.
Figure 14A:
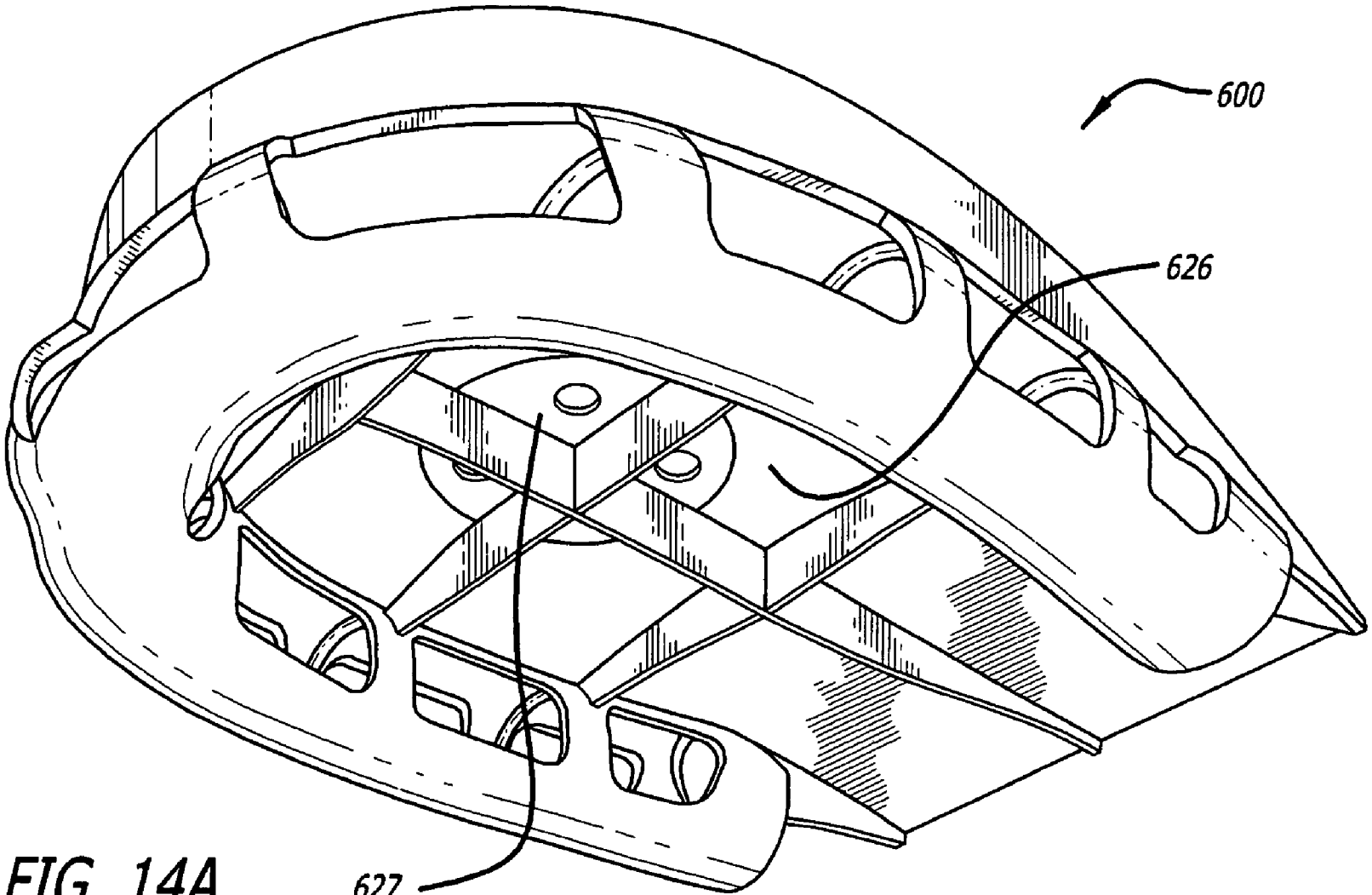
FIG. 14A is a right-side rear bottom perspective view of the component of FIG. 14.
Figure 14B:
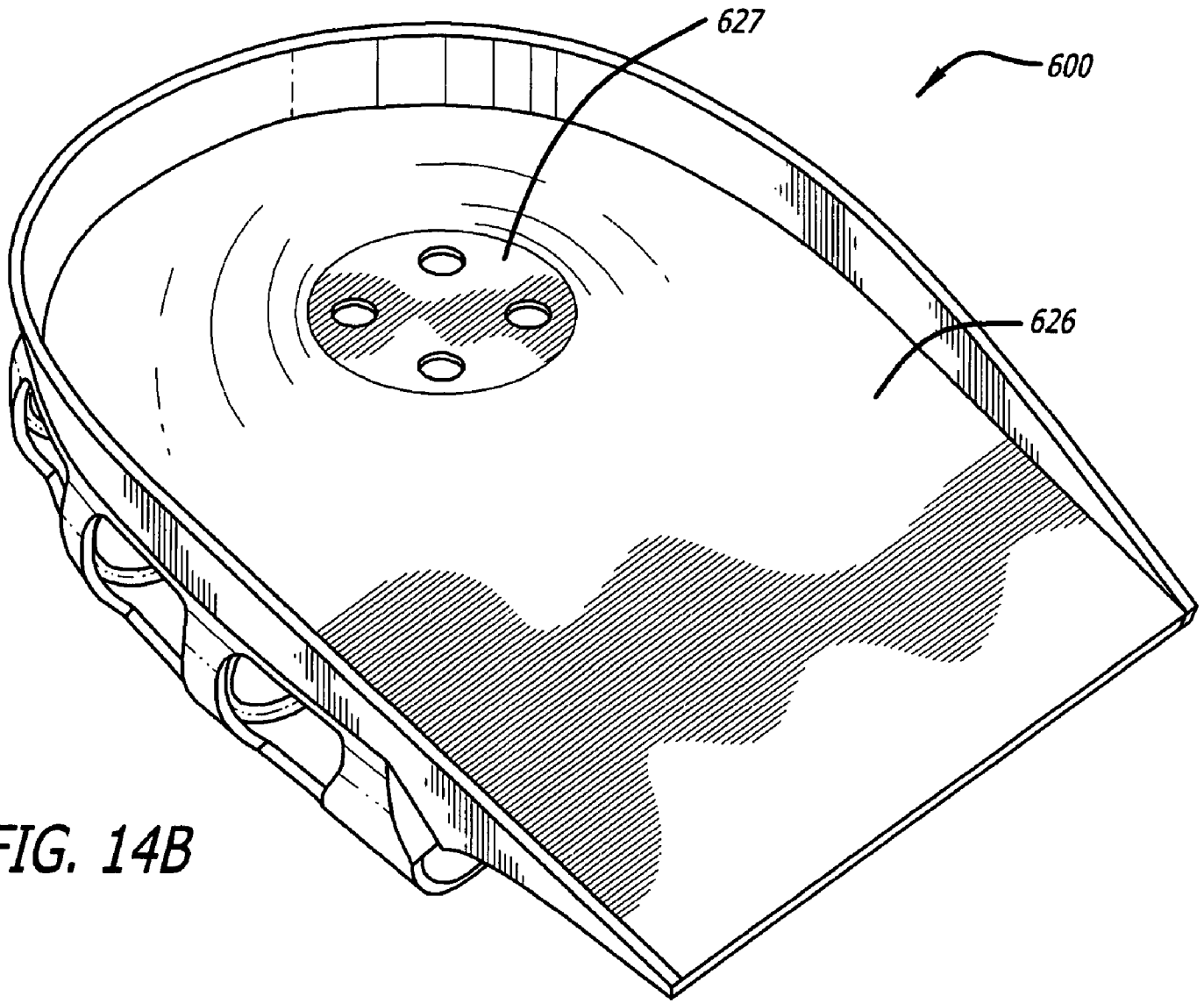
FIG. 14B is a right-side front top perspective view of the component of FIG. 14.

In FIGS. 14 to 14B, yet a further preferred embodiment of a component for use in a shoe of the present invention is shown and generally referred to by the reference number 600. Component 600 is similar to component 500 except for four holes in mid-portion 627 of central portion 626. The addition of one or more holes may increase the flexibility of central portion 626, and/or reduce the weight of the shoe, and/or permit air communication with the interior of the shoe above component 600. Air communication may be desirable to a user seeking better ventilation for the interior portion of the shoe.

Figure 15:
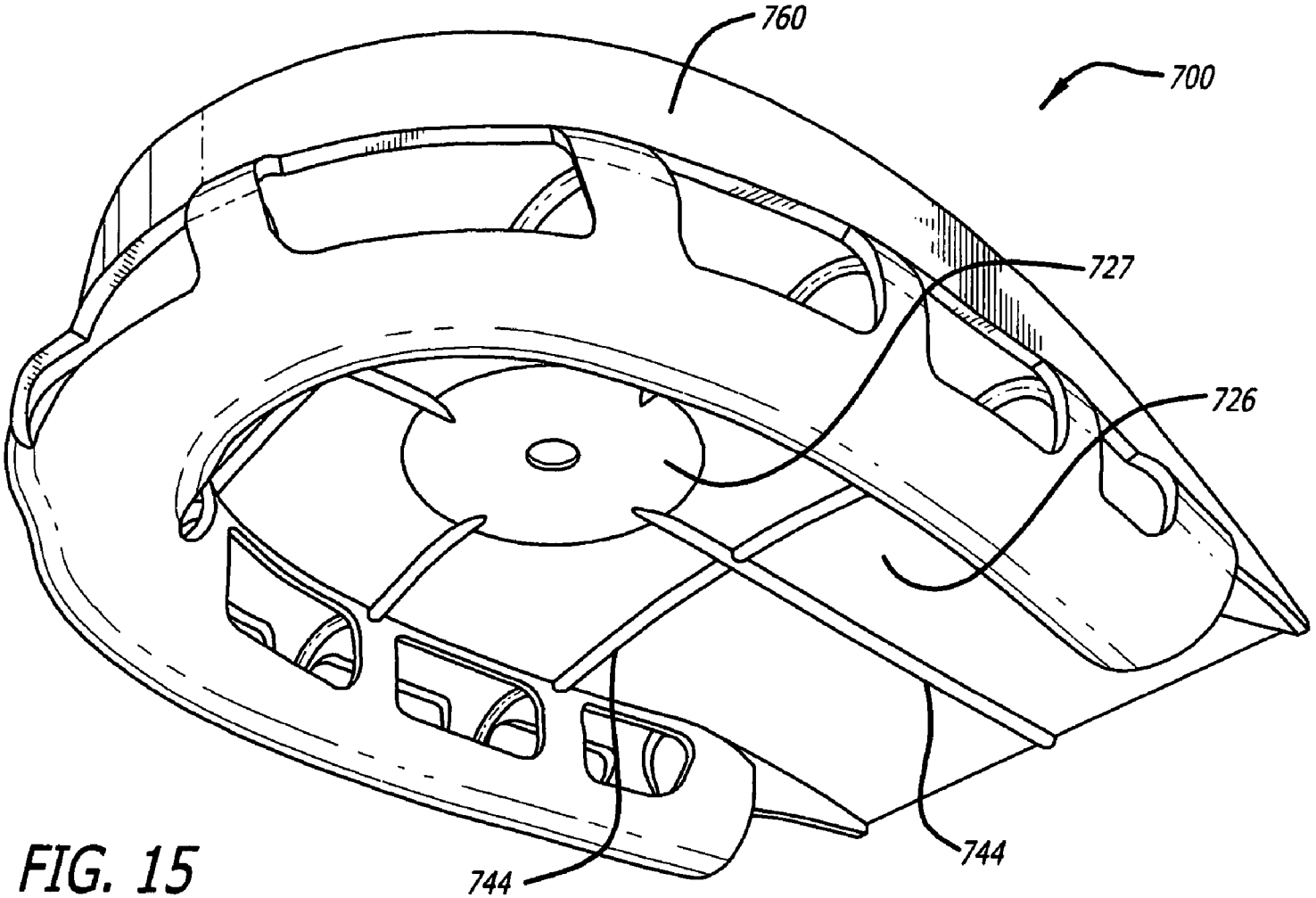
FIG. 15 is a right-side rear bottom perspective view of a component for use in a shoe in accordance with yet an additional preferred embodiment of the present invention.
Figure 15A:
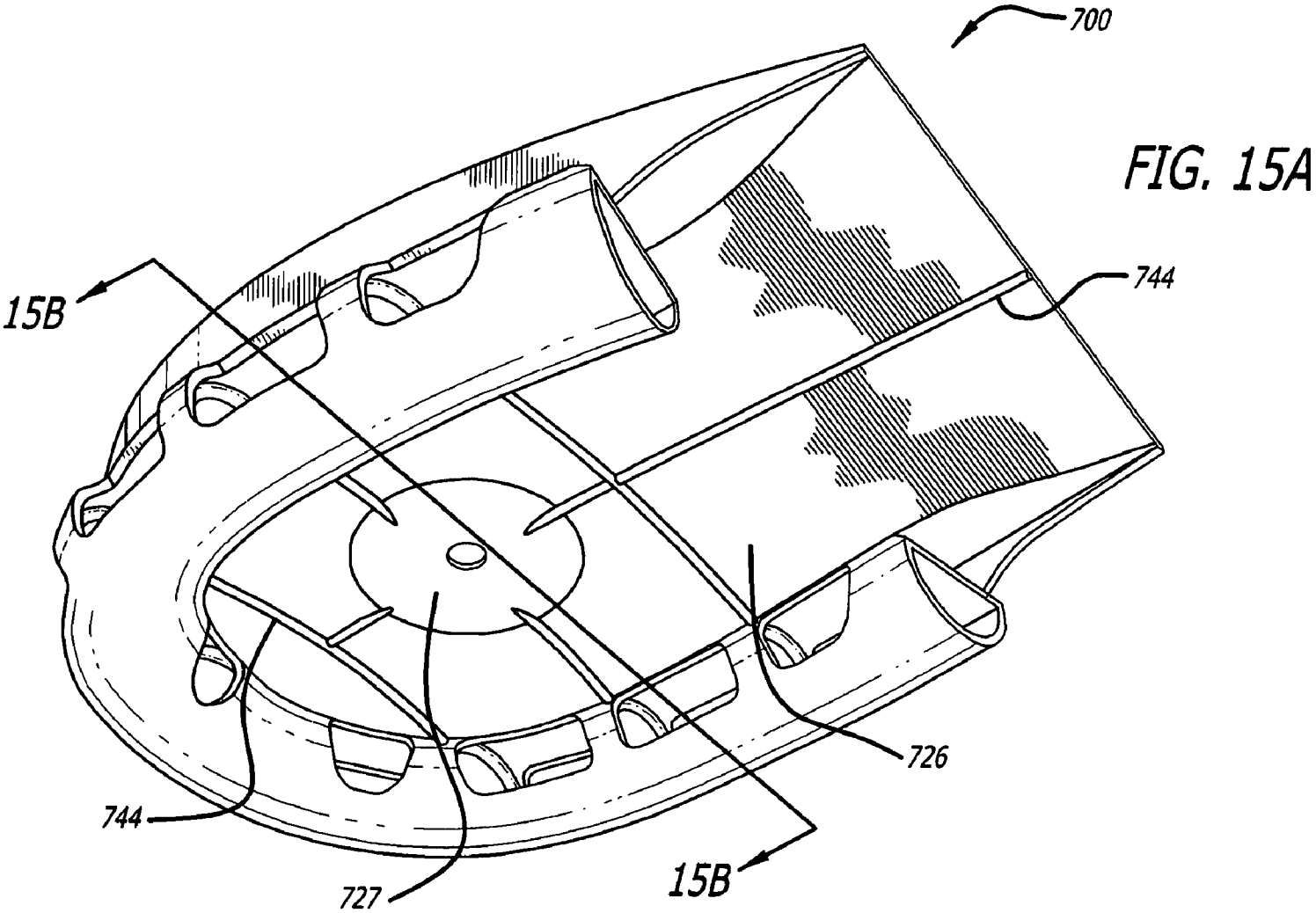
FIG. 15A is a right-side front bottom perspective view of the component of FIG. 15.
Figure 15B:
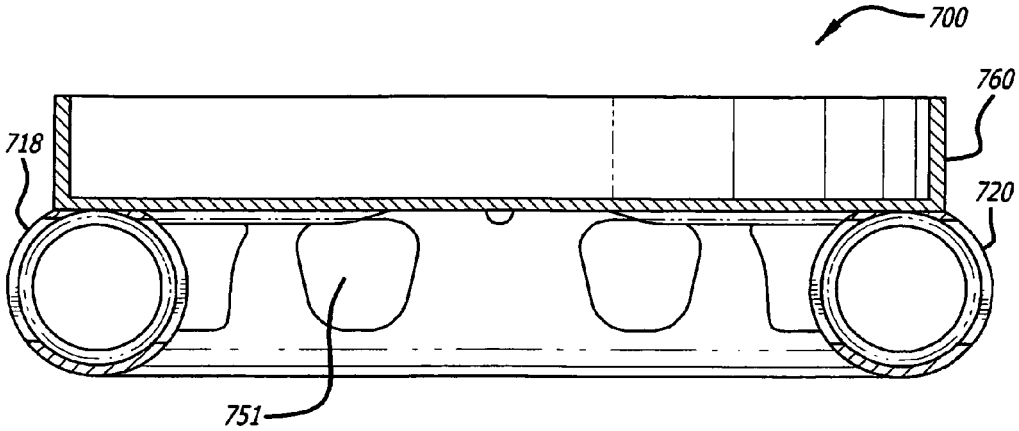
FIG. 15B is a cross-sectional front view of the component of FIG. 15 along plane 15B-15B of FIG. 15.
Figure 15C:
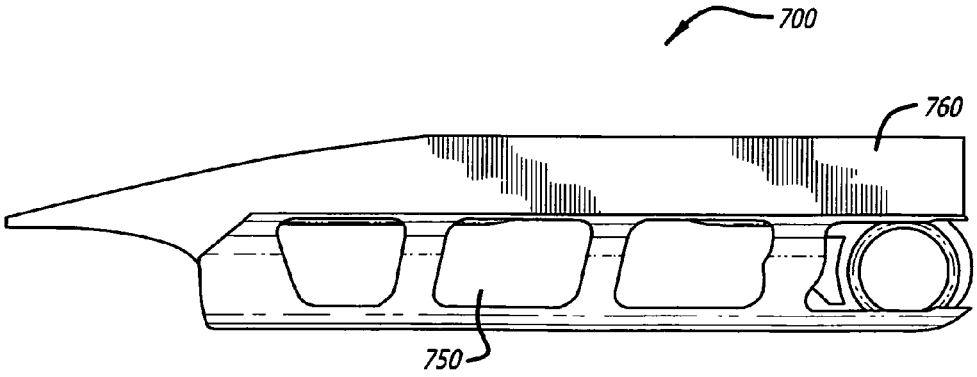
FIG. 15C is a left-side elevation view of the component of FIG. 15.
Figure 15D:
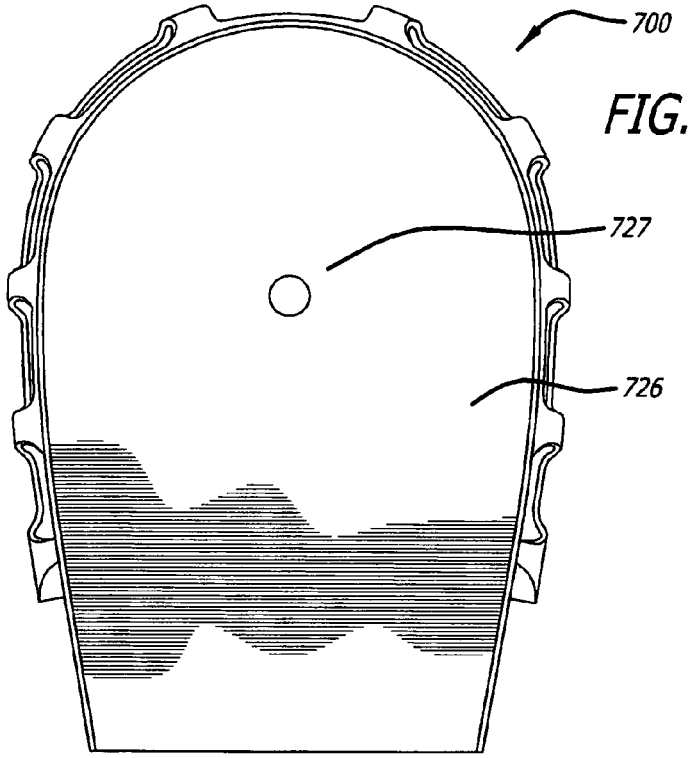
FIG. 15D is a top view of the component of FIG. 15.
Figure 15E:
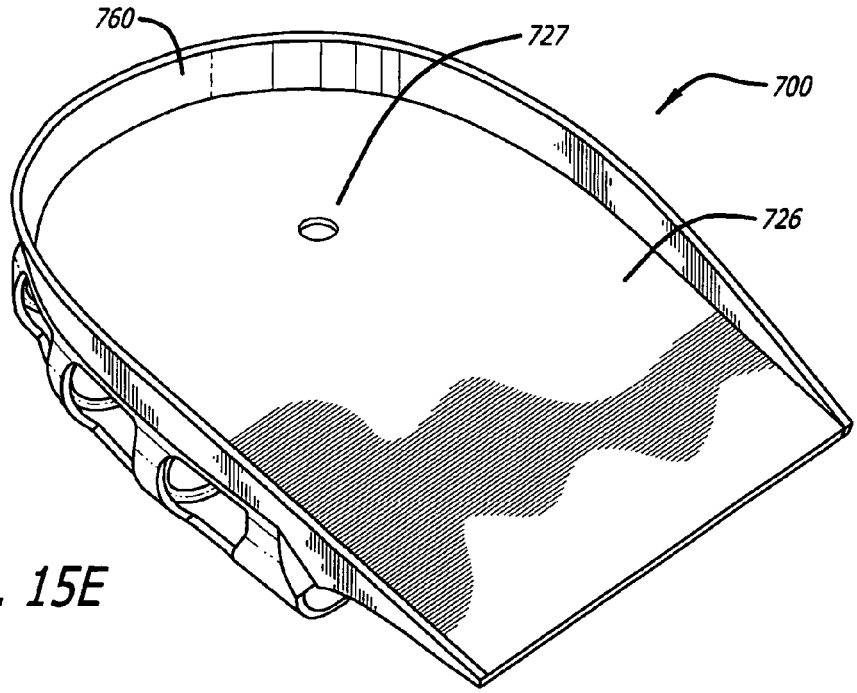
FIG. 15E is a right-side front top perspective view of the component of FIG. 15.

In FIGS. 15 to 15E, yet an additional preferred embodiment of a component for use in a shoe of the present invention is shown and generally referred to by the reference number 700. Component 700 is similar to component 500 except for a centrally located hole in mid-portion 727 of central portion 726 and the absence of ribs 744 proximate the hole in mid-portion 727 of central portion 726. As shown in FIGS. 15D and 15E the upper surface of central portion 726 is flat. Alternatively, it may also be slightly concave with or without changing the lower surface of central portion 726. The addition of the centrally located hole and absence of ribs 744 proximate the hole will allow or increase the flexibility of central portion 726, reduce the weight of the shoe and potentially increase air communication with the interior of the shoe containing component 700.

Figure 16:
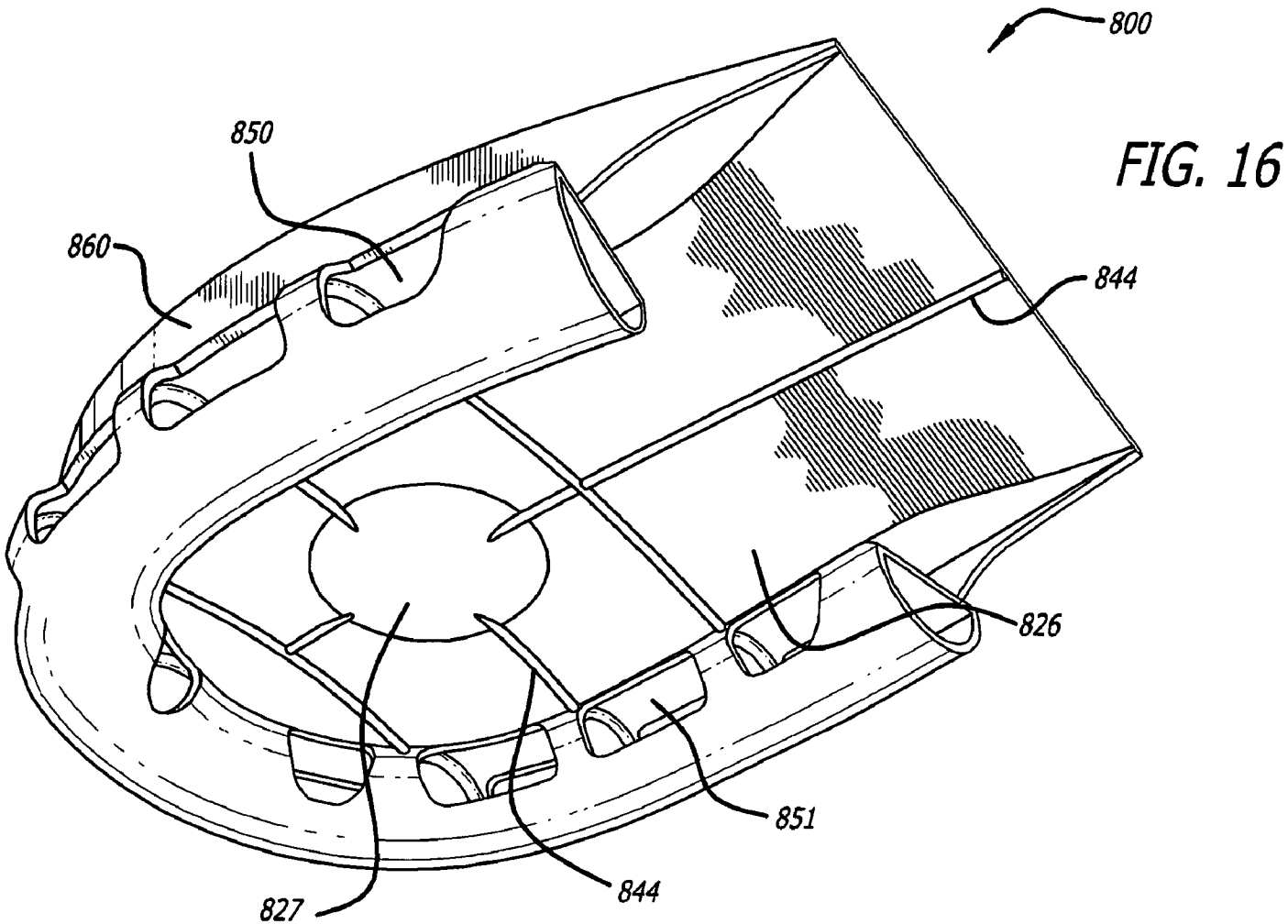
FIG. 16 is a right-side front bottom perspective view of a component for use in a shoe in accordance with yet again an additional preferred embodiment of the present invention.
Figure 16A:
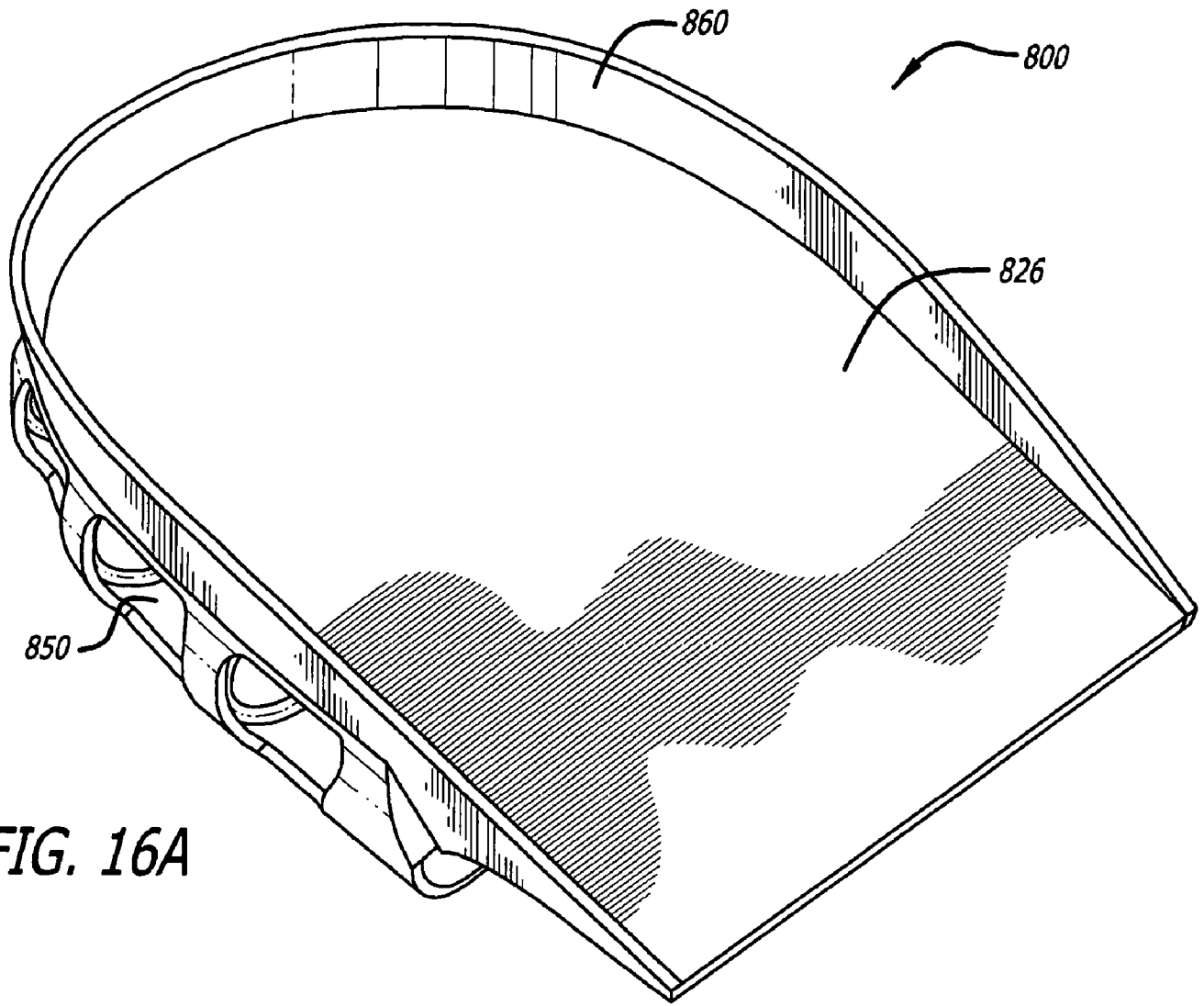
FIG. 16A is a right-side front top perspective view of the component of FIG. 16.

In FIGS. 16 to 16A, yet another preferred embodiment of a component for use in a shoe of the present invention is shown and generally referred to by the reference number 800. Component 800 is similar to component 700 except that no holes are located in central portion 826. The removal of holes will increase the stiffness of central portion 826, and may serve to make the interior of the shoe more impervious to water penetration. The "trade-off," however, may be less ventilation for the user's foot, a feature desired for some shoe models or certain uses.

The component of the present invention may be integrally formed, or may be modular and glued or otherwise attached together. Two examples of integrally forming the component include injection-molding and blow-molding. The component may also be formed integrally with an arch bridge for further stability. The component may include vertically extending walls around its periphery or around the periphery of the central portion to provide lateral stability to the heel of a wearer.

It will be apparent to those skilled in the art that various modifications and variations can be made in the component of the present invention without departing from the scope or spirit of the invention and that certain features of one embodiment may be used interchangeably in other embodiments. By way of example only, the four holes in central portion 626 of component 600 in FIGS. 14-14B can be used in conjunction with any of the above-described components, such as in place of or in addition to the single hole shown in central portion 726 of component 700 in FIGS. 15-15E.

There is disclosed in the above description and the drawings components for use in a shoe, which fully and effectively accomplish the objectives of this invention. However, it will be apparent that variations and modifications of the disclosed embodiments may be made without departing from the principles of the invention.

I claim:

1. A component for use in a shoe, the component comprising:

first and second tubular portions having, respectively, resilient load-bearing first and second hollow tubular walls, one of the was extending generally along a lateral side of a wearer's foot and the other extending generally along a medial side of the wearer's foot, the tubular walls having a thickness, material, and shape providing sufficient strength for supporting and cushioning the lateral and medial sides of the wearer's foot, the tubular walls having an exterior surface with an outwardly oriented portion and an inwardly oriented portion, the inwardly oriented portion of the first and second tubular walls being oriented toward one another, at least one of the first and second tubular walls having a hole through at least one of the outwardly oriented portion and the inwardly oriented portion; and a central portion having a load-bearing central surface disposed between and joined with the first and second tubular portions, the central portion having a strength for supporting and cushioning a width-wise central part of the foot, the central portion not forming a portion of an air-tight enclosure, the central portion having an upper surface and a lower surface, the lower surface of the central portion having at lest one rib.

2. The component of claim 1, wherein the lower surface of the central portion has a plurality of ribs.

3. The component of claim 2, wherein at least two of the ribs intersect one another.

4. The component of claim 2, wherein at least two of the ribs are generally parallel to one another.

5. The component of claim 2, wherein at least two of the ribs extend from side to side along a width of the central portion.

6. The component of claim 2, wherein at least one of the ribs varies in thickness.

7. The component of claim 2, wherein at least one of the ribs varies in cross-sectional shape along a length of the rib.

8. The component of claim 1, wherein the first and second tubular portions have an interior surface having a plurality of ribs.

9. The component of claim 8, wherein at least two of the ribs of the interior surface of the first and second tubular portions are generally parallel with one another.

10. The component of claim 8, wherein the hole through at least one of the outwardly oriented portion and the inwardly oriented portion is through the outwardly oriented portion of at least one of the first and second tubular walls, the at least one hole through the outwardly oriented portion of at least one of the first and second tubular walls intersecting one of the ribs of the interior surface.

11. The component of claim 1, wherein the component is made of plastic.

12. The component of claim 1, wherein the component is made of a plurality of materials.

13. The component of claim 12, wherein the resiliency of a material of the first and second tubular portions is greater than the resiliency of a material of the central portion.

14. The component of claim 1, wherein the hole through at least one of the outwardly oriented portion and the inwardly oriented portion is through the outwardly oriented portion of at least one of the first and second tubular walls.

15. The component of claim 14, wherein the inwardly oriented portion of at least one of the first and second tubular walls includes at least one hole therethrough, the holes of the outwardly oriented portion and the inwardly oriented portion being in air communication with one another.

16. The component of claim 1, wherein the hole through at least one of the outwardly oriented portion and the inwardly oriented portion is through the inwardly oriented portion of at least one of the first and second tubular walls.

17. The component of claim 1, wherein the hole through at least one of the outwardly oriented portion and the inwardly oriented portion is through the outwardly oriented portion of each of the first and second tubular walls, the inwardly oriented portion of each of the first and second tubular walls having at least one hole therethrough, the exterior surface of the tubular walls on the lateral side of the wearer's foot being in air communication with the exterior surface of the tubular wall on the medial side of the wearer's foot through the at least one hole on the outwardly oriented portion on the lateral side and the at least one hole on the inwardly oriented portion on the lateral side and the at least one hole on the inwardly oriented portion on the medial side and the at least one hole on the outwardly oriented portion on the medial side.

18. The component of claim 1, wherein the hole through at least one of the outwardly oriented portion and the inwardly oriented portion is through the outwardly oriented portion of each of the first and second tubular walls, the inwardly oriented portion of each of the first and second tubular walls having at least one hole therethrough, the at least one hole on the outwardly oriented portion on the lateral side and the at least one hole on the inwardly oriented portion on the lateral side and the at least one hole on the inwardly oriented portion on the medial side and the at least one hole on the outwardly oriented portion on the medial side being aligned such that a straight line of sight passes through the first and second tubular walls from lateral side to medial side.

19. The component of claim 1, wherein the first and second tubular portions and the central portion are integrally formed.

20. The component of claim 1, further comprising an integrally formed arch bridge extending forward from the central portion.

21. The component of claim 1, further comprising an integrally formed vertically extending wall around at least a portion of a periphery of the central portion to provide lateral stability to the heel of a wearer.

22. The component of claim 1, wherein the load-bearing central surface of the central portion is resilient.

23. The component of claim 1, wherein the first and second tubular portions have a top, a bottom, and a maximum height therebetween, the central portion being connected to the first and second portions at a position closer to the top of the first and second tubular portions than the bottom of the first and second tubular portions.

24. The component of claim 1, wherein the central portion includes at least one hole therethrough.

25. The component of claim 1, wherein the central portion includes a plurality of holes therethrough.

26. The component of claim 1, wherein at least a portion of the upper surface of the central portion is flat.

27. A component for use in a shoe, the component comprising:

first and second tubular portions having, respectively, resilient load-bearing first and second hollow tubular walls, one of the walls extending generally along a lateral side of a wearer's foot and the other extending generally along a medial side of the wearer's foot, the tubular walls having a thickness, material, and shape providing sufficient strength for supporting and cushioning the lateral and medial sides of the wearers foot, the tubular walls having exterior surface with an outwardly oriented portion and an inwardly oriented portion, the inwardly oriented portion of the first and second tubular walls being oriented toward one another, at least one of the first and second tubular walls having hole through at least one of the out oriented portion and the inwardly oriented portion; and a central portion having a load-bearing central surface disposed between and joined with the first and second tubular portions, the central portion having a strength for supporting and cushioning a width-wise central part of the foot, the central portion not forming a portion of an air-tight enclosure, the central portion having an upper surface and a lower surface, the first and second tubular portions being formed of a material different from a material of the central portion.

28. A component for use in a shoe, the component comprising:

first and second tubular portions having, respectively, resilient load-bearing first and second hollow tubular walls, one of the walls extending generally along a lateral side of a wearer's foot and the other extending generally along a medial side of the wearer's foot, the tubular walls having a thickness, material, and shape providing sufficient strength for supporting and cushioning the lateral and medial sides of the wearer's foot, the tubular walls having an exterior surface with an outwardly oriented portion and an inwardly oriented portion, the inwardly oriented portion of the first and second tubular walls being oriented toward one another, at least one of the first and second tubular walls having a hole through at least one of the outwardly oriented portion and the inwardly oriented portion; and a central portion having a load-bearing central surface disposed between and joined with the first and second tubular portions, the central portion having a strength for supporting and cushioning a width-wise central part of the foot, the central portion not forming a portion of an air-tight enclosure, the central portion having an upper surface and a lower surface, the resiliency of a material of the first and second tubular portions being different from the resiliency of a material of the central portion.

29. A component for use in a shoe, the component comprising:

first and second tubular portions having, respectively, resilient load-bearing first and second hollow tubular walls, one of the walls extending generally along a lateral side of a wearer's foot and the other extending generally along a medial side of the wearer's foot, the tubular walls having a thickness, material, and shape providing sufficient strength for supporting and cushioning the lateral and medial sides of the wearers foot, the tubular walls having an exterior surface with an outwardly oriented portion and an inwardly oriented portion, the inwardly oriented portion of the first and second tubular walls being oriented toward one another, at least one of the first and second tubular walls having a hole through at least one of the outwardly oriented portion and the inwardly oriented portion; and a central portion having a load-bearing central surface disposed between and joined with the first and second tubular portions, the central portion having a strength for supporting and cushioning a width-wise central part of the foot, the central portion not forming a portion of an air-tight enclosure, the central portion having an upper surface and lower surface, at least a substantial portion of the lower surface of the central portion being concave.

30. A component for use in a shoe, the component comprising:

first and second tubular portions having, respectively, resilient load-bearing first and second hollow tubular walls, one of the walls extending generally along a lateral side of a wearer's foot and the other extending generally along a medial side of the wearers foot, the tubular walls having a thickness, material, and shape providing sufficient strength for supporting and cushioning the lateral and medial sides of the wearer's foot the tubular walls having an exterior surface with an outwardly oriented portion and an inwardly oriented portion, the inwardly oriented portion of the first and second tubular walls being oriented toward one another, at least one of the first and second tubular walls having a hole through at least one of the outwardly oriented portion and the inwardly oriented portion; and a central portion having a load-bearing central surface disposed between and joined with the first and second tubular portions, the central portion having a strength for supporting and cushioning a width-wise central part of the foot, the central portion not forming a portion of an air-tight enclosure, the central portion having an upper surface and a lower surface, at least a substantial portion of the upper surface of the central portion being convex.

31. A component for use in a shoe, the component comprising:

first and second tubular portions having, respectively, resilient load-bearing first and second hollow tubular walls, one of the walls extending generally along a lateral side of a wearer's foot and the other extending generally along a medial side of the wearer's foot, the tubular walls having a thickness, material, and shape providing sufficient strength for supporting and cushioning the lateral and medial sides of the wearer's foot, the tubular walls having an exterior surface with an outwardly oriented portion and an inwardly oriented portion, the inwardly oriented portion of the first and second tubular walls being oriented toward one another, at least one of the first and second tubular walls having a hole through at least one of the outwardly oriented portion and the inwardly oriented portion; and a central portion having a load-bearing central surface disposed between and joined with the first and second tubular portions, the central portion having a strength for supporting and cushioning a width-wise central part of the foot, the central portion not forming a portion of an air-tight enclosure, the central portion having an upper surface and a lower surface, at least a substantial portion of the upper surface being concave.

* * * * *

UNITED STATES PATENT AND TRADEMARK OFFICE

CERTIFICATE OF CORRECTION

PATENT NO. : 8,225,533 B2
APPLICATION NO. : 12/454603
DATED : July 24, 2012
INVENTOR(S) : David F. Meschan It is certified that error appears in the above-identified patent and that said Letters Patent is hereby corrected as shown below:

Column 11:
Line 32, insert --an-- after "having";
Line 36, insert --a-- after "having"; and
Line 37, change "out" to --outwardly--.

Column 12:
Line 41, change "foot" to --foot,--.

Signed and Sealed this
Twelfth Day of March, 2013

Teresa Stanek Rea
*Acting Director of the United States Patent and Trademark Office*